US009630761B2

(12) United States Patent
Willey et al.

(10) Patent No.: US 9,630,761 B2
(45) Date of Patent: Apr. 25, 2017

(54) PACKAGING

(75) Inventors: Jason Denis Willey, Barry (GB); Parbinder Cheema, Middlesex (GB)

(73) Assignee: Mondelez UK Holding & Services Limited, Uxbridge (GB)

( * ) Notice: Subject to any disclaimer, the term of this patent is extended or adjusted under 35 U.S.C. 154(b) by 559 days.

(21) Appl. No.: 13/124,692

(22) PCT Filed: Oct. 14, 2009

(86) PCT No.: PCT/GB2009/002462

§ 371 (c)(1),
(2), (4) Date: Jul. 5, 2011

(87) PCT Pub. No.: WO2010/046623

PCT Pub. Date: Apr. 29, 2010

(65) Prior Publication Data

US 2011/0253771 A1 Oct. 20, 2011

(30) Foreign Application Priority Data

Oct. 20, 2008 (GB) ..... 0819200.7
Nov. 21, 2008 (GB) ..... 0821354.8

(51) Int. Cl.
*B65D 75/00* (2006.01)
*B65D 75/58* (2006.01)

(52) U.S. Cl.
CPC ..... *B65D 75/5833* (2013.01); *B65D 75/5855* (2013.01); *B65D 2575/586* (2013.01)

(58) Field of Classification Search
CPC B65D 75/5838; B65D 75/5833; B65D 75/12; B65D 75/5855; B65D 2575/586
USPC ..... 229/87.05, 87.07, 87.14; 383/210, 211
See application file for complete search history.

(56) References Cited

U.S. PATENT DOCUMENTS

| | | | |
|---|---|---|---|
| 401,974 | A | 4/1889 | Smith |
| 811,092 | A | 1/1906 | Roberts |
| 1,065,012 | A | 6/1913 | Watanabe |
| 1,106,721 | A | 8/1914 | Lewis |

(Continued)

FOREIGN PATENT DOCUMENTS

| | | |
|---|---|---|
| AU | 768679 | 6/2001 |
| AU | 2002334419 B2 | 5/2003 |

(Continued)

OTHER PUBLICATIONS

'Cheese Range', Mintel gnpd, Jan. 26, 2001, Mintel Publishing, 1 page.

(Continued)

*Primary Examiner* — Peter Helvey
(74) *Attorney, Agent, or Firm* — Hoffmann & Baron, LLP

(57) ABSTRACT

Packaging for a generally block shaped product (12) is made from a wrapper (14) of flexible material encasing the product. The wrapper has a foldable flap portion (24) adjacent an end of the package. The free edges (28, 30, 32) of the flap over-lap a further portion (34) of the wrapper and are bonded by means of a peelable and re- sealable adhesive (37). The flap (24) extends fully across one face (38) of the package and at least partially down opposing sides to form a sealed and re-sealable closure for the package. The package can be formed using flow-wrap techniques and is particular suited for packaging chocolate bars and the like.

13 Claims, 10 Drawing Sheets

(56) References Cited

U.S. PATENT DOCUMENTS

| | | | | | |
|---|---|---|---|---|---|
| 1,171,462 | A | | 2/1916 | Rice | |
| 1,791,352 | A | | 2/1931 | Pascual | |
| 1,963,639 | A | | 12/1931 | Ahlquist | |
| 1,949,161 | A | | 6/1932 | Haug | |
| 1,978,035 | A | | 9/1932 | Thom | |
| 2,033,550 | A | | 3/1936 | Rosen | |
| 2,034,007 | A | | 3/1936 | Elizabeth | |
| 2,066,495 | A | | 1/1937 | Swift | |
| 2,079,328 | A | * | 5/1937 | McBean | 229/87.05 |
| 2,128,196 | A | | 8/1938 | Max | |
| 2,248,578 | A | * | 7/1941 | Moore | 229/80 |
| 2,260,064 | A | | 10/1941 | Stokes | |
| 2,320,143 | A | * | 5/1943 | Johnson | 229/87.07 |
| 2,321,042 | A | | 6/1943 | Preis | |
| 2,330,015 | A | | 9/1943 | Stokes | |
| 2,621,788 | A | | 10/1948 | Hitchcock | |
| 2,475,236 | A | | 7/1949 | Matthew | |
| 2,605,897 | A | | 10/1949 | Rundle | |
| 2,554,160 | A | | 5/1951 | Von | |
| 2,684,807 | A | | 7/1954 | Gerrish | |
| 2,719,647 | A | | 10/1955 | Olive | |
| 2,823,795 | A | | 2/1958 | Moore | |
| 2,965,224 | A | | 12/1960 | Harwood | |
| 3,080,238 | A | | 3/1963 | Howard | |
| 3,127,273 | A | | 3/1964 | Monahan | |
| 3,179,326 | A | | 4/1965 | Underwood | |
| 3,186,628 | A | | 6/1965 | Rohde | |
| 3,187,982 | A | | 6/1965 | Underwood | |
| 3,217,871 | A | | 11/1965 | Lee | |
| 3,235,165 | A | | 2/1966 | Jackson | |
| 3,245,525 | A | | 4/1966 | Shoemaker | |
| 3,259,303 | A | * | 7/1966 | Repko | 383/203 |
| 3,260,358 | A | | 7/1966 | Gottily | |
| 3,272,422 | A | | 9/1966 | Miller | |
| 3,291,377 | A | | 12/1966 | Eggen | |
| 3,298,505 | A | | 1/1967 | Stephenson | |
| 3,311,032 | A | | 3/1967 | Lucas | |
| 3,326,450 | A | | 6/1967 | Langdon | |
| 3,331,501 | A | | 7/1967 | Stewart | |
| 3,343,541 | A | | 9/1967 | Bellamy | |
| 3,373,922 | A | | 3/1968 | Watts | |
| 3,373,926 | A | | 3/1968 | Voigtman | |
| 3,454,210 | A | | 7/1969 | Spiegel | |
| 3,471,005 | A | * | 10/1969 | Sexstone | 206/260 |
| 3,520,401 | A | | 7/1970 | Richter | |
| 3,528,825 | A | | 9/1970 | Doughty | |
| 3,570,751 | A | | 3/1971 | Trewella | |
| 3,595,466 | A | | 7/1971 | Rosenburg | |
| 3,595,468 | A | | 7/1971 | Repko | |
| 3,618,751 | A | | 11/1971 | Rich | |
| 3,630,346 | A | | 12/1971 | Burnside | |
| 3,651,615 | A | | 3/1972 | Bohner | |
| 3,653,502 | A | | 4/1972 | Beaudoin | |
| 3,685,720 | A | | 8/1972 | Brady | |
| 3,687,352 | A | | 8/1972 | Kalajian | |
| 3,740,238 | A | | 6/1973 | Graham | |
| 3,740,328 | A | | 6/1973 | Rausch | |
| 3,757,078 | A | | 9/1973 | Conti | |
| 3,790,744 | A | | 2/1974 | Bowen | |
| 3,811,564 | A | | 5/1974 | Braber | |
| 3,865,302 | A | | 2/1975 | Kane | |
| 3,885,727 | A | | 5/1975 | Gilley | |
| 3,905,646 | A | | 9/1975 | Brackmann | |
| 3,909,582 | A | | 9/1975 | Bowen | |
| 3,910,410 | A | | 10/1975 | Shaw | |
| 3,938,659 | A | | 2/1976 | Wardwell | |
| 3,966,046 | A | | 6/1976 | Deutschlander | |
| 3,971,506 | A | | 7/1976 | Roenna | |
| 3,979,050 | A | | 9/1976 | Cilia | |
| 4,082,216 | A | | 4/1978 | Clarke | |
| 4,113,104 | A | | 9/1978 | Meyers | |
| 4,140,046 | A | | 2/1979 | Marbach | |
| 4,143,695 | A | | 3/1979 | Hoehn | |
| 4,156,493 | A | | 5/1979 | Julius | |
| 4,185,754 | A | | 1/1980 | Julius | |
| 4,192,420 | A | | 3/1980 | Worrell, Sr. | |
| 4,192,448 | A | | 3/1980 | Porth | |
| 4,197,949 | A | | 4/1980 | Carlsson | |
| 4,210,246 | A | | 7/1980 | Kuchenbecker | |
| 4,258,876 | A | | 3/1981 | Ljungcrantz | |
| 4,260,061 | A | | 4/1981 | Jacobs | |
| 4,273,815 | A | | 6/1981 | Gifford | |
| 4,285,681 | A | | 8/1981 | Walitalo | |
| 4,306,367 | A | | 12/1981 | Otto | |
| 4,327,862 | A | | 5/1982 | Jakobs | |
| 4,337,862 | A | | 7/1982 | Suter | |
| 4,364,478 | A | | 12/1982 | Tuens | |
| 4,397,415 | A | | 8/1983 | Lisiecki | |
| 4,411,365 | A | | 10/1983 | Horikawa | |
| 4,420,080 | A | | 12/1983 | Nakamura | |
| 4,428,477 | A | | 1/1984 | Cristofolo | |
| 4,460,088 | A | * | 7/1984 | Rugenstein et al. | 206/494 |
| 4,464,154 | A | | 8/1984 | Ljungcrantz | |
| 4,488,647 | A | | 12/1984 | Davis | |
| 4,506,488 | A | | 3/1985 | Matt et al. | |
| 4,518,087 | A | | 5/1985 | Goglio | |
| 4,538,396 | A | | 9/1985 | Nakamura | |
| 4,545,844 | A | | 10/1985 | Buchanan | |
| 4,548,824 | A | | 10/1985 | Mitchell | |
| 4,548,852 | A | | 10/1985 | Mitchell | |
| 4,549,063 | A | | 10/1985 | Ang | |
| 4,550,831 | A | | 11/1985 | Whitford | |
| 4,552,269 | A | | 11/1985 | Chang | |
| 4,557,505 | A | | 12/1985 | Schaefer | |
| 4,570,820 | A | | 2/1986 | Murphy | |
| 4,572,377 | A | | 2/1986 | Beckett | |
| 4,589,943 | A | | 5/1986 | Kimball | |
| 4,608,288 | A | | 8/1986 | Spindler | |
| 4,610,357 | A | | 9/1986 | Nakamura | |
| 4,613,046 | A | | 9/1986 | Kuchenbecker | |
| 4,616,470 | A | | 10/1986 | Nakamura | |
| 4,625,495 | A | | 12/1986 | Holovach | |
| 4,638,911 | A | | 1/1987 | Prohaska | |
| 4,648,509 | A | | 3/1987 | Alves | |
| 4,651,874 | A | | 3/1987 | Nakamura | |
| 4,653,250 | A | | 3/1987 | Nakamura | |
| 4,658,963 | A | | 4/1987 | Jud | |
| 4,667,453 | A | | 5/1987 | Goglio | |
| 4,671,453 | A | | 6/1987 | Cassidy | |
| 4,673,085 | A | | 6/1987 | Badouard | |
| 4,679,693 | A | | 7/1987 | Forman | |
| 4,694,960 | A | | 9/1987 | Phipps | |
| 4,696,404 | A | | 9/1987 | Corella | |
| 4,709,399 | A | | 11/1987 | Sanders | |
| 4,723,301 | A | | 2/1988 | Chang | |
| 4,738,365 | A | | 4/1988 | Prater | |
| 4,739,879 | A | | 4/1988 | Nakamura | |
| 4,770,325 | A | | 9/1988 | Gordon | |
| 4,784,885 | A | | 11/1988 | Carespodi | |
| 4,786,355 | A | | 11/1988 | Kontz | |
| 4,790,436 | A | * | 12/1988 | Nakamura | 206/449 |
| 4,798,295 | A | | 1/1989 | Rausing | |
| 4,798,296 | A | | 1/1989 | Lagerstedt | |
| 4,799,594 | A | | 1/1989 | Blackman | |
| 4,811,848 | A | * | 3/1989 | Jud | 383/205 |
| 4,818,120 | A | | 4/1989 | Addiego | |
| 4,838,429 | A | | 6/1989 | Fabisiewicz | |
| 4,840,270 | A | | 6/1989 | Caputo | |
| 4,845,470 | A | | 7/1989 | Boldt | |
| 4,848,575 | A | | 7/1989 | Nakamura | |
| 4,858,780 | A | | 8/1989 | Odaka | |
| 4,863,064 | A | | 9/1989 | Dailey | |
| 4,865,198 | A | | 9/1989 | Butler | |
| 4,866,911 | A | | 9/1989 | Grindrod | |
| 4,874,096 | A | | 10/1989 | Tessera-Chiesa | |
| 4,876,123 | A | | 10/1989 | Rivera | |
| 4,889,731 | A | | 12/1989 | Williams | |
| 4,901,505 | A | | 2/1990 | Williams, Jr. | |
| 4,902,142 | A | | 2/1990 | Lammert | |
| 4,917,247 | A | | 4/1990 | Jud | |
| 4,943,439 | A | | 7/1990 | Andreas | |
| 4,972,953 | A | | 11/1990 | Friedman | |
| 4,998,666 | A | | 3/1991 | Ewan | |
| 4,999,081 | A | | 3/1991 | Buchanan | |

(56) References Cited

U.S. PATENT DOCUMENTS 5,000,320 A 3/1991 Kuchenbecker
5,001,325 A 3/1991 Huizinga
5,005,264 A 4/1991 Breen
5,010,231 A 4/1991 Huizinga
5,018,625 A 5/1991 Focke
5,029,712 A 7/1991 OBrien
5,040,685 A 8/1991 Focke
5,046,621 A 9/1991 Bell
5,048,718 A 9/1991 Nakamura
5,054,619 A * 10/1991 Muckenfuhs ..... 206/494
5,060,848 A 10/1991 Ewan
5,065,868 A 11/1991 Cornelissen
5,076,439 A 12/1991 Kuchenbecker
5,077,064 A 12/1991 Hustad
5,078,509 A 1/1992 Center
5,082,702 A 1/1992 Alband
5,085,724 A 2/1992 Focke
5,096,113 A 3/1992 Focke
5,100,003 A 3/1992 Jud
5,103,980 A 4/1992 Kuchenbecker
5,108,669 A 4/1992 vanDijk
5,124,388 A 6/1992 Pruett
5,125,211 A 6/1992 OBrien
5,134,001 A 7/1992 Osgood
5,158,499 A 10/1992 Guckenberger
5,161,350 A 11/1992 Nakamura
5,167,455 A * 12/1992 Forman ..... 383/66
5,167,974 A 12/1992 Grindrod
5,174,659 A 12/1992 Laske
5,184,771 A 2/1993 Jud
5,190,152 A 3/1993 Smith
5,197,618 A 3/1993 Goth
5,222,422 A 6/1993 Benner
5,222,813 A 6/1993 Kopp
5,229,180 A 7/1993 Littmann
5,294,470 A 3/1994 Ewan
5,307,988 A 5/1994 Focke
5,310,262 A 5/1994 Robison
5,333,735 A 8/1994 Focke
5,344,007 A 9/1994 Nakamura
5,352,466 A 10/1994 Delonis
5,356,068 A 10/1994 Moreno
5,366,087 A 11/1994 Bane
5,371,997 A 12/1994 Kopp
5,374,179 A 12/1994 Swanson
5,375,698 A 12/1994 Ewart
5,381,643 A 1/1995 Kazaitis
5,382,190 A 1/1995 Graves
5,388,757 A 2/1995 Lorenzen
5,405,629 A 4/1995 Marnocha
5,407,070 A 4/1995 Bascos
5,409,115 A 4/1995 Barkhorn
5,409,116 A 4/1995 Aronsen
5,439,102 A * 8/1995 Brown et al. ..... 206/63.3
5,454,207 A 10/1995 Storandt
5,460,838 A 10/1995 Wermund
5,460,844 A 10/1995 Gaylor
5,461,845 A 10/1995 Yeager
5,464,092 A 11/1995 Seeley
5,470,015 A 11/1995 Jud
5,489,060 A 2/1996 Godard
5,499,757 A 3/1996 Back
5,503,858 A 4/1996 Reskow
5,505,305 A 4/1996 Scholz
5,515,965 A 5/1996 Boldrini
5,519,982 A 5/1996 Herber
5,520,939 A 5/1996 Wells
5,524,759 A * 6/1996 Herzberg et al. ..... 206/494
5,531,325 A 7/1996 Deflander
5,538,129 A 7/1996 Chester
5,550,346 A 8/1996 Andriash
5,558,438 A 9/1996 Warr
5,582,342 A 12/1996 Jud
5,582,853 A 12/1996 Marnocha
5,582,887 A 12/1996 Etheredge
5,591,468 A 1/1997 Stockley
5,630,308 A 5/1997 Guckenberger
5,633,058 A 5/1997 Hoffer
5,636,732 A 6/1997 Gilels
5,637,369 A 6/1997 Stewart
5,647,100 A 7/1997 Porchia
5,647,506 A 7/1997 Julius
5,664,677 A 9/1997 OConnor
5,672,224 A 9/1997 Kaufmann
5,688,394 A 11/1997 McBride
5,688,463 A 11/1997 Robichaud
5,702,743 A 12/1997 Wells
5,709,479 A 1/1998 Bell
5,725,311 A * 3/1998 Ponsi et al. ..... 383/66
D394,204 S 5/1998 Seddon
D394,605 S 5/1998 Skiba
5,749,657 A 5/1998 May
5,770,283 A 6/1998 Gosselin
5,791,465 A 8/1998 Niki
5,795,604 A 8/1998 Wells
5,819,931 A 10/1998 Boucher
5,820,953 A 10/1998 Beer
5,833,368 A 11/1998 Kaufman
5,855,435 A 1/1999 Chiesa
5,862,101 A 1/1999 Haas
5,873,483 A 2/1999 Goertz
5,873,607 A 2/1999 Waggoner
5,882,116 A 3/1999 Backus
5,885,673 A 3/1999 Light
5,906,278 A 5/1999 Ponsi
5,908,246 A 6/1999 Arimura
5,928,749 A 7/1999 Forman
5,938,013 A 8/1999 Palumbo
5,939,156 A 8/1999 Rossi
5,945,145 A 8/1999 Narsutis
5,956,794 A 9/1999 Skiba
5,993,962 A 11/1999 Timm
5,996,797 A 12/1999 Flaig
5,997,177 A 12/1999 Kaufman
6,006,907 A * 12/1999 Sato et al. ..... 206/387.1
6,012,572 A 1/2000 Heathcock
6,015,934 A 1/2000 Lee
6,026,953 A * 2/2000 Nakamura et al. ..... 206/233
6,028,289 A 2/2000 Robichaud
6,029,809 A 2/2000 Skiba
6,037,381 A 3/2000 Beer
6,056,141 A 5/2000 Navarini
6,060,095 A 5/2000 Scrimager
6,065,591 A 5/2000 Dill
6,066,437 A 5/2000 Kosslinger
6,076,969 A 6/2000 Jaisle
6,077,551 A * 6/2000 Scrimager ..... 426/107
6,099,682 A 8/2000 Krampe
6,113,271 A 9/2000 Scott
6,125,614 A 10/2000 Jones
6,126,009 A 10/2000 Shiffler
6,126,317 A * 10/2000 Anderson et al. ..... 383/207
6,152,601 A 11/2000 Johnson
6,164,441 A 12/2000 Guy
6,213,645 B1 4/2001 Beer
6,228,450 B1 5/2001 Pedrini
D447,054 S 8/2001 Hill
6,273,610 B1 8/2001 Koyama
6,279,297 B1 8/2001 Latronico
6,296,884 B1 10/2001 Okerlund
6,299,355 B1 10/2001 Schneck
6,309,104 B1 10/2001 Koch
6,309,105 B1 * 10/2001 Palumbo ..... 383/211
6,318,894 B1 11/2001 Derenthal
6,325,877 B1 12/2001 Murphy
6,352,364 B1 3/2002 Mobs
6,364,113 B1 4/2002 Faasse
6,365,255 B1 4/2002 Kittel
6,383,592 B1 5/2002 Lowry
6,402,379 B1 6/2002 Albright
6,420,006 B1 7/2002 Scott
6,427,420 B1 8/2002 Olivieri
6,428,208 B1 8/2002 Addison
6,428,867 B1 8/2002 Scott

(56) References Cited

U.S. PATENT DOCUMENTS 6,446,811 B1 9/2002 Wilfong
6,450,685 B1 9/2002 Scott
6,457,585 B1 10/2002 Huffer
6,461,043 B1 10/2002 Healy
6,461,708 B1 10/2002 Dronzek
6,471,817 B1 10/2002 Emmert
6,476,743 B1 11/2002 Brown
6,482,867 B1 11/2002 Kimura
6,502,986 B1 1/2003 Bensur
6,517,243 B2 2/2003 Huffer
6,519,918 B2 2/2003 Forman et al.
6,538,581 B2 3/2003 Cowie
6,539,691 B2 4/2003 Beer
6,554,134 B1 * 4/2003 Guibert ..... 206/494
6,563,082 B2 5/2003 Terada
6,589,622 B1 7/2003 Scott
6,592,260 B1 7/2003 Randall
6,594,872 B2 7/2003 Cisek
6,612,432 B2 9/2003 Motson
6,616,334 B2 9/2003 Faaborg
6,621,046 B2 9/2003 Kaji
6,669,046 B1 12/2003 Sawada
6,691,886 B1 2/2004 Berndt
6,698,928 B2 3/2004 Miller
6,726,054 B2 4/2004 Fagen
6,726,364 B2 4/2004 Perell
6,746,743 B2 6/2004 Knoerzer
6,750,423 B2 6/2004 Tanaka
6,767,604 B2 7/2004 Muir
6,815,634 B2 11/2004 Sonoda
6,821,388 B2 11/2004 Marsh
6,852,947 B2 2/2005 Tanaka
6,865,860 B2 * 3/2005 Arakawa et al. ..... 53/412
6,889,483 B2 5/2005 Compton
6,918,532 B2 7/2005 Sierra-Gomez
6,929,400 B2 8/2005 Razeti
6,932,135 B2 8/2005 Tabuchi
6,951,999 B2 10/2005 Monforton
6,969,196 B2 11/2005 Woodham
6,983,875 B2 1/2006 Emmott
7,007,423 B2 3/2006 Andersson
7,018,502 B2 3/2006 Treleaven
7,021,827 B2 4/2006 Compton
7,032,754 B2 * 4/2006 Kopecky ..... 206/460
7,032,757 B2 4/2006 Richards
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos
7,207,718 B2 4/2007 Machacek
7,207,719 B2 4/2007 Marbler
7,213,710 B2 5/2007 Cotert
7,228,968 B1 6/2007 Burgess
7,254,873 B2 8/2007 Stolmeier
7,261,468 B2 8/2007 Schneider
7,262,335 B2 8/2007 Motsch
7,302,783 B2 12/2007 Cotert
7,344,744 B2 3/2008 Sierra-Gomez
7,350,688 B2 4/2008 Sierra-Gomez
7,351,458 B2 4/2008 Leighton
7,352,591 B2 4/2008 Sugahara
7,371,008 B2 5/2008 Bonenfant
7,404,487 B2 7/2008 Kumakura
7,422,142 B2 9/2008 Arippol
7,470,062 B2 12/2008 Moteki
7,475,781 B2 1/2009 Kobayashi
7,516,599 B2 4/2009 Doll
7,527,189 B2 * 5/2009 Billig et al. ..... 229/149
7,533,733 B2 5/2009 Nolan
7,533,773 B2 5/2009 Aldridge
7,600,641 B2 10/2009 Burgess
7,703,602 B2 4/2010 Saito
7,708,463 B2 5/2010 Sampaio Camacho
7,717,620 B2 * 5/2010 Hebert et al. ..... 383/203
7,740,923 B2 6/2010 Exner
7,744,517 B2 6/2010 Bonenfant
7,758,484 B2 7/2010 Peterson
7,858,901 B2 12/2010 Krishnan
7,963,413 B2 6/2011 Sierra-Gomez
2,588,409 A1 7/2011 Aldridge
7,971,718 B2 7/2011 Aldridge
8,002,171 B2 8/2011 Ryan
8,002,941 B2 8/2011 Exner
8,029,428 B2 10/2011 Selle
8,038,349 B2 * 10/2011 Andersson et al. ..... 383/205
8,114,451 B2 2/2012 Sierra-Gomez
8,181,784 B2 5/2012 Bouthiette
8,240,546 B2 8/2012 Friebe
8,262,830 B2 9/2012 Hebert
8,262,832 B2 9/2012 Hebert
8,273,434 B2 9/2012 Zietlow
8,308,363 B2 11/2012 Vogt
8,408,792 B2 4/2013 Cole
8,506,165 B2 * 8/2013 Shinozaki et al. ..... 383/207
8,540,839 B2 9/2013 Zietlow
8,544,519 B2 10/2013 Ikeda
8,763,890 B2 7/2014 Clark
8,920,030 B2 12/2014 McSweeney
8,951,591 B2 2/2015 Vogt
8,986,803 B2 3/2015 Yoshida
8,999,100 B2 4/2015 Carmichael
2001/0000480 A1 4/2001 Stagg
2002/0000441 A1 1/2002 Redmond
2002/0068668 A1 6/2002 Chow
2002/0079247 A1 6/2002 Wilfong
2002/0182359 A1 12/2002 Muir
2003/0002753 A1 1/2003 Stolmeier
2003/0019780 A1 1/2003 Parodi
2003/0039412 A1 2/2003 Rodick
2003/0047695 A1 3/2003 Zik
2003/0051440 A1 3/2003 Chow
2003/0053720 A1 3/2003 Smith
2003/0118255 A1 6/2003 Miller
2003/0127352 A1 * 7/2003 Buschkiel et al. ..... 206/494
2003/0170357 A1 9/2003 Garwood
2003/0180486 A1 9/2003 Pape
2003/0183637 A1 10/2003 Zappa
2003/0183643 A1 10/2003 Fagen
2003/0201083 A1 10/2003 Marsh
2003/0210838 A1 11/2003 Steele
2003/0217946 A1 11/2003 Hsu
2003/0223656 A1 12/2003 Razeti
2004/0011677 A1 * 1/2004 Arakawa et al. ..... 206/216
2004/0035719 A1 2/2004 Ebbers
2004/0060974 A1 4/2004 Dacey
2004/0062838 A1 4/2004 Castellanos
2004/0067326 A1 4/2004 Knoerzer
2004/0083680 A1 5/2004 Compton
2004/0086207 A1 5/2004 Marbler
2004/0091184 A1 5/2004 Miller
2004/0112010 A1 6/2004 Richards
2004/0150221 A1 8/2004 Brown
2004/0175060 A1 9/2004 Woodham
2004/0180118 A1 9/2004 Renger
2004/0206637 A1 10/2004 Sierra-Gomez
2005/0000965 A1 1/2005 Boardman
2005/0031233 A1 2/2005 Varanese
2005/0084186 A1 4/2005 Caris
2005/0084188 A1 4/2005 Liao
2005/0116016 A1 6/2005 LoDuca
2005/0117819 A1 6/2005 Kingsford
2005/0186368 A1 8/2005 Leighton
2005/0220371 A1 10/2005 Machacek
2005/0247764 A1 11/2005 Sierra-Gomez
2005/0276525 A1 12/2005 Hebert
2005/0276885 A1 12/2005 Bennett
2005/0284776 A1 12/2005 Kobayashi
2006/0000738 A1 1/2006 Kumakura
2006/0018569 A1 1/2006 Bonenfant
2006/0066096 A1 3/2006 Kan
2006/0083446 A1 4/2006 SampaioCamacho
2006/0124494 A1 6/2006 Clark

(56) References Cited

U.S. PATENT DOCUMENTS

| | | | | |
|---|---|---|---|---|
| 2006/0144911 | A1 | 7/2006 | Sierra-Gomez | |
| 2006/0147129 | A1 | 7/2006 | Miller | |
| 2006/0171611 | A1 | 8/2006 | Rapparini | |
| 2006/0199717 | A1 | 9/2006 | Marbler | |
| 2006/0251342 | A1 | 11/2006 | Forman | |
| 2006/0257056 | A1 | 11/2006 | Miyake | |
| 2006/0257599 | A1 | 11/2006 | Exner | |
| 2006/0261050 | A1 | 11/2006 | Krishnan | |
| 2006/0283750 | A1 | 12/2006 | Villars | |
| 2006/0285779 | A1 | 12/2006 | Golas | |
| 2007/0023435 | A1 | 2/2007 | Sierra-Gomez | |
| 2007/0023436 | A1* | 2/2007 | Sierra-Gomez et al. | 220/359.2 |
| 2007/0095709 | A1 | 5/2007 | Saito | |
| 2007/0140600 | A1 | 6/2007 | Nowak | |
| 2007/0209959 | A1 | 9/2007 | Burgess | |
| 2007/0269142 | A1 | 11/2007 | Tyska | |
| 2007/0275133 | A1 | 11/2007 | Sierra-Gomez | |
| 2008/0013869 | A1 | 1/2008 | Forman | |
| 2008/0031555 | A1 | 2/2008 | Roberts | |
| 2008/0034713 | A1 | 2/2008 | Kohl | |
| 2008/0037911 | A1 | 2/2008 | Cole | |
| 2008/0041750 | A1 | 2/2008 | Kohlweyer | |
| 2008/0053861 | A1 | 3/2008 | Mellin | |
| 2008/0060751 | A1 | 3/2008 | Arrindell | |
| 2008/0063324 | A1 | 3/2008 | Bernard | |
| 2008/0063759 | A1 | 3/2008 | Raymond | |
| 2008/0063760 | A1 | 3/2008 | Raymond | |
| 2008/0101733 | A1 | 5/2008 | Fenn-Barrabass | |
| 2008/0131035 | A1 | 6/2008 | Rogers | |
| 2008/0135428 | A1 | 6/2008 | Tallier | |
| 2008/0152264 | A1 | 6/2008 | Pokusa | |
| 2008/0156861 | A1 | 7/2008 | Sierra-Gomez | |
| 2008/0159666 | A1 | 7/2008 | Exner | |
| 2008/0199109 | A1 | 8/2008 | Rutzinger | |
| 2008/0203141 | A1 | 8/2008 | Friebe | |
| 2008/0214376 | A1 | 9/2008 | Bonenfant | |
| 2008/0220227 | A1 | 9/2008 | Keeney | |
| 2008/0240627 | A1 | 10/2008 | Cole | |
| 2008/0273821 | A1 | 11/2008 | Doll | |
| 2008/0292225 | A1 | 11/2008 | Dayrit | |
| 2009/0001143 | A1 | 1/2009 | Cowan | |
| 2009/0014491 | A1 | 1/2009 | Fuisz | |
| 2009/0022431 | A1 | 1/2009 | Conner | |
| 2009/0028472 | A1* | 1/2009 | Andersson et al. | 383/205 |
| 2009/0053372 | A1 | 2/2009 | Hambrick | |
| 2009/0074333 | A1 | 3/2009 | Griebel | |
| 2009/0097786 | A1 | 4/2009 | Goglio | |
| 2009/0161995 | A1 | 6/2009 | Henderson | |
| 2009/0190866 | A1 | 7/2009 | Hughes | |
| 2009/0211938 | A1* | 8/2009 | Aldridge | 206/526 |
| 2009/0226117 | A1 | 9/2009 | Davis | |
| 2009/0232425 | A1 | 9/2009 | Tai | |
| 2009/0273179 | A1 | 11/2009 | Scott | |
| 2009/0301903 | A1 | 12/2009 | Andersson | |
| 2010/0002963 | A1 | 1/2010 | Holbert | |
| 2010/0018974 | A1 | 1/2010 | Lyzenga | |
| 2010/0019022 | A1 | 1/2010 | Ryan | |
| 2010/0111453 | A1* | 5/2010 | Dierl | 383/204 |
| 2010/0113241 | A1* | 5/2010 | Hebert et al. | 493/213 |
| 2010/0147724 | A1 | 6/2010 | Mitra-Shah | |
| 2010/0172604 | A1 | 7/2010 | Andersson | |
| 2010/0226598 | A1 | 9/2010 | Stoeppelmann | |
| 2010/0230303 | A1* | 9/2010 | Buse et al. | 206/268 |
| 2010/0230411 | A9 | 9/2010 | Sierra-Gomez | |
| 2010/0278454 | A1 | 11/2010 | Huffer | |
| 2010/0303391 | A9 | 12/2010 | Cole | |
| 2011/0035399 | A1 | 2/2011 | Deng | |
| 2011/0049158 | A1 | 3/2011 | Bouthiette | |
| 2011/0058755 | A1 | 3/2011 | Guibert | |
| 2011/0127319 | A1 | 6/2011 | Golden | |
| 2011/0132976 | A1 | 6/2011 | Drewnowski | |
| 2011/0147443 | A1* | 6/2011 | Igo | 229/117.31 |
| 2011/0204056 | A1 | 8/2011 | Veternik et al. | |
| 2011/0253718 | A1 | 10/2011 | Sierra-Gomez | |
| 2012/0125932 | A1 | 5/2012 | Sierra-Gomez | |
| 2012/0128835 | A1 | 5/2012 | Lyzenga | |
| 2012/0177307 | A1 | 7/2012 | Duan | |
| 2013/0004626 | A1 | 1/2013 | Renders et al. | |
| 2013/0011527 | A1 | 1/2013 | Renders | |
| 2013/0064477 | A1 | 3/2013 | Vogt | |
| 2013/0064934 | A1 | 3/2013 | Vogt | |
| 2013/0114918 | A1 | 5/2013 | Lyzenga | |
| 2013/0121623 | A1 | 5/2013 | Lyzenga | |
| 2013/0121624 | A1 | 5/2013 | Lyzenga | |
| 2013/0205964 | A1 | 8/2013 | Matsushita | |
| 2013/0270268 | A1 | 10/2013 | Lyzenga | |
| 2014/0185965 | A1 | 7/2014 | Lyzenga | |
| 2014/0270597 | A1 | 9/2014 | Friedman | |
| 2014/0314339 | A1 | 10/2014 | Docherty | |
| 2015/0016756 | A1 | 1/2015 | Down | |
| 2015/0021219 | A1 | 1/2015 | SeyfferthDeOliveira | |

FOREIGN PATENT DOCUMENTS

| | | | |
|---|---|---|---|
| AU | 2004295316 | | 6/2005 |
| AU | 2005254459 | | 12/2005 |
| AU | 2006337982 | | 8/2007 |
| AU | 2007309154 | | 5/2008 |
| AU | 2008223524 | | 9/2008 |
| AU | 2008229190 | | 9/2008 |
| BR | 55008852 | | 11/2001 |
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 3700988 | A1 | 7/1988 |
| DE | 3835721 | A1 | 5/1990 |
| DE | 9003401 | | 5/1990 |
| DE | 9005297 | | 8/1990 |
| DE | G90140656 | | 4/1991 |
| DE | 4134567 | | 1/1993 |
| DE | 4241423 | | 6/1994 |
| DE | 19738411 | | 3/1999 |
| DE | 19822328 | A1 | 11/1999 |
| DE | 20113173 | U1 | 10/2001 |
| DE | 202004012301 | | 12/2004 |
| DE | 20122333 | U1 | 3/2005 |
| DE | 202007005487 | | 6/2007 |
| DE | 102007030267 | A1 | 1/2009 |
| DE | 202009000302 | | 3/2009 |
| DE | 102010019867 | A1 | 9/2011 |
| EP | 0085289 | | 8/1983 |
| EP | 0298054 | A2 | 1/1989 |
| EP | 0307924 | A2 | 3/1989 |
| EP | 0388310 | | 9/1990 |
| EP | 0396967 | A2 | 11/1990 |
| EP | 408831 | A1 | 1/1991 |
| EP | 0474981 | A1 | 6/1991 |
| EP | 0447636 | | 9/1991 |
| EP | 0488967 | | 6/1992 |
| EP | 0546369 | | 6/1993 |
| EP | 0608909 | | 8/1994 |
| EP | 0613824 | | 9/1994 |
| EP | 0629561 | A2 | 12/1994 |
| EP | 0661154 | | 7/1995 |
| EP | 0667828 | | 8/1995 |
| EP | 0669204 | B2 | 8/1995 |
| EP | 0744357 | | 11/1996 |
| EP | 0752375 | | 1/1997 |
| EP | 0758993 | | 2/1997 |
| EP | 0796206 | | 9/1997 |
| EP | 0796208 | | 9/1997 |
| EP | 0905048 | A | 3/1999 |
| EP | 1010638 | A1 | 6/2000 |
| EP | 1046594 | | 10/2000 |
| EP | 1056066 | | 11/2000 |
| EP | 1 086 906 | A2 | 3/2001 |
| EP | 1136379 | | 9/2001 |
| EP | 1 288 139 | A1 | 3/2003 |
| EP | 1318081 | A1 | 6/2003 |
| EP | 1350741 | | 10/2003 |
| EP | 1375380 | A1 | 1/2004 |
| EP | 1382543 | A2 | 1/2004 |

(56) References Cited

FOREIGN PATENT DOCUMENTS

| | | | |
|---|---|---|---|
| EP | 1437311 | A1 | 7/2004 |
| EP | 1449789 | A1 | 8/2004 |
| EP | 1457424 | | 9/2004 |
| EP | 1467929 | | 10/2004 |
| EP | 1468936 | | 10/2004 |
| EP | 1477425 | A1 | 11/2004 |
| EP | 1488936 | | 12/2004 |
| EP | 1608567 | | 12/2005 |
| EP | 1609737 | | 12/2005 |
| EP | 1619137 | A1 | 1/2006 |
| EP | 1 637 472 | A1 | 3/2006 |
| EP | 1697230 | | 9/2006 |
| EP | 1351861 | | 10/2006 |
| EP | 1712468 | | 10/2006 |
| EP | 1712488 | A1 | 10/2006 |
| EP | 1755980 | | 2/2007 |
| EP | 1760006 | A1 | 3/2007 |
| EP | 1770025 | | 4/2007 |
| EP | 1846306 | | 10/2007 |
| EP | 1858776 | | 11/2007 |
| EP | 1873082 | A1 | 1/2008 |
| EP | 1908696 | | 4/2008 |
| EP | 1939107 | | 7/2008 |
| EP | 1975081 | A1 | 10/2008 |
| EP | 2033910 | | 3/2009 |
| EP | 2189506 | | 5/2010 |
| FR | 1327914 | A | 5/1963 |
| FR | 2674509 | | 10/1992 |
| FR | 2693988 | | 1/1994 |
| FR | 2766794 | | 2/1999 |
| FR | 2783512 | | 3/2000 |
| GB | 1107200 | | 3/1968 |
| GB | 2171077 | | 8/1986 |
| GB | 2266513 | | 11/1993 |
| GB | 2276095 | A | 9/1994 |
| GB | 2335652 | A | 9/1999 |
| GB | 2339187 | A | 1/2000 |
| JP | 57163658 | | 10/1982 |
| JP | S5822411 | B2 | 5/1983 |
| JP | 6080405 | | 5/1985 |
| JP | 62171479 | | 10/1987 |
| JP | 63022370 | | 1/1988 |
| JP | 01167084 | A | 6/1989 |
| JP | 01226579 | A | 9/1989 |
| JP | 01267182 | A | 10/1989 |
| JP | H11343468 | | 12/1990 |
| JP | H0581083 | | 11/1993 |
| JP | 09142551 | A | 6/1997 |
| JP | 09150872 | | 6/1997 |
| JP | H09156677 | A | 6/1997 |
| JP | 1059441 | | 3/1998 |
| JP | 10059441 | | 3/1998 |
| JP | 10120016 | A1 | 5/1998 |
| JP | 10129685 | | 5/1998 |
| JP | H10152179 | A | 9/1998 |
| JP | 11198977 | | 7/1999 |
| JP | 2000335542 | A | 12/2000 |
| JP | 2001114357 | | 4/2001 |
| JP | 2001301807 | | 10/2001 |
| JP | 2002002805 | A | 1/2002 |
| JP | 2002104550 | A | 4/2002 |
| JP | 200326224 | | 1/2003 |
| JP | 2003026224 | A | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |
| JP | 2007045434 | | 2/2007 |
| JP | 2009166870 | | 7/2009 |
| NZ | 555274 | | 12/2008 |
| WO | 8606350 | | 11/1986 |
| WO | 9104920 | | 4/1991 |
| WO | 9411270 | | 5/1994 |
| WO | 9411270 | A1 | 5/1994 |
| WO | 9532902 | A1 | 12/1995 |
| WO | 9725200 | | 7/1997 |
| WO | 0061458 | A | 10/2000 |
| WO | 0064755 | | 11/2000 |
| WO | 0140073 | A1 | 6/2001 |
| WO | 02064365 | A1 | 8/2002 |
| WO | 02066341 | | 8/2002 |
| WO | 03013976 | A1 | 2/2003 |
| WO | 03035504 | | 5/2003 |
| WO | 03037727 | | 5/2003 |
| WO | 03059776 | A1 | 7/2003 |
| WO | 2004087527 | A1 | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | A2 | 11/2005 |
| WO | 2005120989 | | 12/2005 |
| WO | 2005123535 | A1 | 12/2005 |
| WO | 2006055128 | A2 | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008/051813 | A1 | 5/2008 |
| WO | 2008062159 | A1 | 5/2008 |
| WO | 2008074060 | | 6/2008 |
| WO | 2008/115693 | A1 | 9/2008 |
| WO | 2008108969 | | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | A2 | 5/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011032064 | | 3/2011 |
| WO | 2011121337 | A2 | 10/2011 |
| WO | 2011123410 | | 10/2011 |
| WO | 2011146616 | | 11/2011 |
| WO | 2011146627 | | 11/2011 |
| WO | 2011146658 | | 11/2011 |
| WO | 2012036765 | | 3/2012 |
| WO | 2012098412 | | 7/2012 |

OTHER PUBLICATIONS

'Elite Edam Cheese', Mintel gnpd, Dec. 3, 2001, Mintel Publishing, 2 pages.

'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.

'New Easy Peel Cheese Packaging', Mintel gnpd, Aug. 10, 2001, Mintel Publishing.

'New on the Shelf-Product Instructions and Packaging Trends', Circle Reader Service Card No. 93, Aug. 1998, Baking & Snack.

'Soft Bread Sticks', Mintel gnpd, Mar. 20, 1998, Mintel Publishing, 1 page.

"Wall's Bacon " A Sizzling Success Story and The Grocer: "When sealed delivers", the second page of which bears a date of Aug. 21, 1999.

40 Packaging News PPMA Preview Sep. 2001.

Additional Exhibits from Declaration of James Lukas Jr. filed Mar. 26, 2015, 73 pages.

Declaration of James J. Lukas, Jr. in Support of Defendants' Motion for Summary Judgment with Exhibits, Part 1 dated Mar. 23, 2015, 277 pages.

(56) References Cited

OTHER PUBLICATIONS

Declaration of James J. Lukas, Jr. in Support of Defendants' Opposition to Plaintiffs Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Answer, Affirmative Defenses, and Counterclaims Responsive to Complaint, dated Apr. 5, 2012, 25 pages.
Defendants' Consolidated Memorandum in Support of Motion for Summary Judgement (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit 8-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
Defendants' Initial Non-Infringement Contentions Pursuant to LPR 2.3(a), dated May 17, 2013, 7 pages.
Defendants' Invalidity Contentions-Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' Invalidity Contentions—Exhibit A-5, dated May 17, 2013, 39 pages.
Defendants' Invalidity Contentions Pursuant to LPR 2.3, dated May 17, 2013, 23 pages.
Defendants' Local Rule 56.1 Statement of Material Facts in Support of Motion for Summary Judgment (redacted), dated Mar. 23, 2015, 75 pages.
Defendants' LPR 2.3 Initial Non-Infringement Contentions Exhibit A, dated May 17, 2013, 39 pages.
Defendants' LR 56.1 (b) (3) (C) Statement of Additional Material Facts in Support of Their Opposition to Plaintiffs Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Response to Plaintiffs Local Rule 56.1 Statement of Material Facts in Support of Plaintiff's Motions for Summary Judgment, dated May 28, 2015, 108 pages.
Defendants' Supplemental Memorandum of Law Regarding Additional Claim Construction Authority Requested by the Court, dated Feb. 28, 2014, 13 pages.
Defendants' Unenforceability Contentions Pursuant to LPR 2.3, dated May 17, 2013, 13 pages.
English Translation of JP H09-156677 published on Jun. 17, 1997, 2 pages.
Machine translation of claim for BR 5500885-2 from Googletranslate.com; 1 page.
Machine translation of claim for BR 6202030-7 from Googletranslate.com; 1 page.
Machine translation of claim for BR 6804636-7 from Googletranslate.com; 1 page.
English Translation of Japanese Official Notice of Rejection mailed on Feb. 14, 2012 in JP Application No. 2009-172352, citing Japanese Laid Open Application No. 62-171479, 3 pages.
English Translation of Japanese Unexamined Application Publication No. H9-156677, published Jul. 17, 1997; 6 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published on Jan. 29, 2003, 13 pages.
English Translation of JP H09-156677 published Jun. 17, 1995; 8 pgs.
English Translation of JP Official Notice of Rejection mailed on Jan. 29, 2013 in JP Appl. No. 2008-087152 citing JPH0581083, 5 pages.
European Packaging Pack Report, NR. May 5, 2001 and partial translation thereof, 6 pages.
European Search Report, EP10305289 citing DE1848870U, 3 pages
European Search Report 06118142.6 dated May 3, 2007, citing DE90140656, 10 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiffs Cross-Motion for Summary Judgment (redacted), dated May 8, 2015, 300 pages.
Exhibits, part 3, to Declaration of James J. Lukas, Jr. In Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5. To Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted),dated May 8, 2015, 136 pages.

(56) References Cited

OTHER PUBLICATIONS

Fuji Packaging GmbH Fachpack brochure, Oct. 11-12, 2001; 2 pages.
Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Kellogg's Opening Claim Construction Brief, dated Dec. 13, 2013, 30 pages.
Kellogg's Reply Claim Construction Brief, dated Jan. 24, 2014, 19 pages.
Kellogg's Response to Plaintiff's Surreply Claim Construction Brief Pursuant to Docket No. 98, dated Feb. 28, 2014, 9 pages.
Machine translation of CN 1781819A published Jun. 7, 2006 from google.com/patents; 13 pages, accessed Jun. 5, 2014.
Machine translation of DE 202007005487, published Jun. 14, 2007, provided by Espacenet, 3 pages.
Machine translation of DE 202009000302, published Mar. 19, 2009, provided by Espacenet, 9 pages.
Machine translation of DE9014065, published Mar. 19, 2009, provided by Espacenet, 9 pages.
Machinery Update, Mar./Apr. 2002, pp. 56-62.
Machinery Update, Mar./Apr. 2002, pp. 59-60.
Machinery Update, Sep./Oct. 2001, pp. 46-47.
Opposition to EP1679269 filed by Awapatent AB, Helsingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Patent Abstracts of Japan, vol. 1997 No. 10, Oct. 31, 1997 and JP09156677 A (Fuji Seal Co. Ltd.) (Jun. 17, 1997) abstract in English and 7 figures.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's Initial Response to Defendant's Initial Invalidity Contentions, dated May 31, 2013, 20 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Reply in Support of its Motions for Summary Judgment, dated Jun. 1, 2015, 19 pages.
Plaintiff Intercontinental Great Brands LLC's Responsive Claim Construction Brief Pursuant to LPR 4.2, dated Feb. 10, 2014, 27 pages.
Plaintiff Intercontinental Great Brands LLC's Submission of Authority Pursuant to Docket No. 98, dated Feb. 28, 2014, 11 pages.
Plaintiff Intercontinental Great Brands LLC's Surreply Claim Construction Brief Pursuant to Docket No. 98, dated Feb. 21, 2014, 6 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
U.S. District Court for the Northern District of Illinois, Eastern Division Memorandum Opinion and Order, dated Sep. 22, 2014, 12 pages.
Defendants' Memorandum in Support of Their Motion to Compel Discovery, dated Oct. 13, 2014, 13 pages.
Defendants' Motion to Compel Discovery, dated Oct. 13, 2014, 3 pages.
Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Plaintiff's Memorandum of Law in Opposition to Defendants' Motion to Compel Discovery, Oct. 15, 2014, 12 pages.
Machine Translation of EP 1449789 description. Translated on Jun. 13, 2015, 18 pages.
Defendant's Local Rule 56.1 Statement of Material Facts in Support of Motion for Summary Judgment, dated Mar. 23, 2015, 75 pages.
Machine Translation of the description of DE 3835721. Translation provided by USPTO in U.S. Appl. No. 14/005,783, dated Jan. 21, 2016, 17 pages.
Definition of "end." Webster's New World Dictionary, Third College Edition. 1988 Simon & Schuster, cited by USPTO in U.S. Appl. No. 11/193,614, dated Jan. 21, 2016, 3 pages.
Non-Confidential Brief for Plaintiff-Appellant Intercontinental Great Brands LLC, dated Dec. 30, 2015, 149 pages, filed with the Federal Circuit in Case Nos. 2015-2082, -2084 (litigation related to U.S. Pat. No. 6,918,532).
English Translation of JP2006137445 filed by Shimomura, published Jun. 1, 2006, translation provided by the USPTO in U.S. Appl. No. 13/698,567, 18 pages.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.
English Translation of JP2003-026224 published Jan. 29, 2003, translated on Jul. 27, 2015. Translation provided by USPTO in U.S. Appl. No. 14/175,434, 9 pages.
English Translation of JP2001-301807 published Oct. 31, 2001, translated on Jul. 27, 2015. Translation provided by USPTO in U.S. Appl. No. 14/175,434, 6 pages.

* cited by examiner

PACKAGING

CROSS-REFERENCE TO RELATED APPLICATIONS

This application is the National Stage of International Application No. PCT/GB 2009/002462, which designates the U.S., filed Oct. 14, 2009, which claims the benefit of GB 0819200.7, filed Oct. 20, 2008, and GB 0821354.8, filed Nov. 21, 2008, the contents of which are incorporated by reference herein.

TECHNICAL FIELD OF THE INVENTION

The present invention relates to packaging, and in particular to improved packaging for generally block-shaped products. The present invention is also directed to a method of packaging such products and to the combination of a substantially rigid, generally block shaped product and a flexible wrapper encasing the product.

BACKGROUND TO THE INVENTION

It is known to package generally block-shaped products, including food products such as chocolate bars and other snack type confectionery products, in a wrapper that is fabricated from a substantially gas and moisture impervious material, such as a metal foil, or a plastics material (including a laminate of either or both materials), in order to protect the product.

Such known wrappers may be formed from a length of flat, foldable material having an inner surface directed to the food product and an outer surface. The outer surface may be printed on or otherwise be provided with information for the consumer. The material is folded about the product and the longitudinal side edges are bonded together to form a longitudinal sealed seam, sometimes referred to as a "fin seal" or "fin seam". The material extends beyond the ends of the product and opposing edge regions at either end of the wrapper are bonded together to form transverse end seams. The seams may be formed using an adhesive to bond the opposing surfaces of the wrapper or by heating the material under pressure so that the opposing surfaces melt and fuse together to form a welded seam.

Packaging of this nature can be produced using a flow-wrap method in which a film of material is supplied in a roll to package a number of products in a substantially continuous process. The material is fed through a machine which folds it about each product in turn so that opposing side edges are brought into contact and bonded together to form the longitudinal seam, which usually extends along a rear face of the product. The material is crimped at either end of the product to form the end seams and the material is cut to separate each package from the remainder of the film. Alternatively, packaging may also be formed by envelope or sheet feeding and sealing is effected by means of pressure and/or heat.

The known packaging forms a fully sealed container for the product, which is substantially gas and moisture impervious. However, the material used to form such packages is typically quite tough it can be difficult to open as it does not easily tear in a controlled fashion, often requiring multiple tears to get the product out of the wrapper.

Furthermore, the known packaging is not re-closable once opened. This limits the shelf life of the product after opening and allows spillage of the remaining contents. Many larger chocolate bars are divided into portions with the intention that a consumer will break off one or more portions at a time and keep the reminder for later use. Typically, a consumer has to push the remaining bar back into the wrapper after a portion has been removed and fold the open end of the wrapper over. When the consumer wishes to break off some more of the bar, the wrapper has to be unfolded and the remaining bar pushed back out. This can be a cumbersome procedure and does not ensure the remaining contents are kept secure. This arrangement can also be rather messy for the consumer as small parts of the bar may break-off but are not securely retained in the wrapper when it is folded over.

In order to make this type of packaging easier to open, it has been proposed in GB 1, 107, 200 A to use a peelable and re-sealable adhesive coating to form the longitudinal seam and to provide folded tabs that can be grasped by a consumer and pulled apart to peel open the longitudinal seam. This arrangement helps in making the packaging easier to open and enables the packaging to be reclosed after opening. However, it has been found that the packaging is not wholly effective in securely retaining the remaining contents as it relies on the re-sealable coating to hold the longitudinal seam together. This is a particular problem with packaging for larger portioned bars which may be opened and re-sealed a number of times, as the resealable coating tends to become less effective with continued opening over time compromising the integrity of the packaging.

Other known types of packaging for generally blocked shaped products are formed from one or more sheets of flexible material. In one such known arrangement, a sheet of flexible material is folded about the product along one edge and opposing portions of the sheet are bonded or welded together along the other three edges to enclose the product. A further known form of flexible packaging comprises two sheets of flexible material positioned one on either side of the product and bonded/welded together along all four edges to form a sealed package. Where the material used to form the packages is a metal foil, laminate or other tough material, these can suffer from similar problems in terms of being difficult to open and not being re-closable.

It is an object of the invention to provide an improved packaging for a generally block-shaped product which overcomes or at least mitigates some or all of the above problems.

It is a further object of the invention to provide improved methods of packaging a generally block-shaped product which overcomes or at least mitigates some or all of the above problems.

It is a still further object of the invention to provide a combination of a substantially rigid, generally block-shaped product and a flexible wrapper encasing the product which overcomes or at least mitigates some or all of the problems of the prior art.

SUMMARY OF THE INVENTION

In accordance with a first aspect of the invention, there is provided packaging for a generally block shaped product, the packaging comprising a wrapper of flexible material encasing the product, the wrapper having a foldable flap portion adjacent an end of the package, the free edges of the flap overlapping a further portion of the wrapper and being bonded thereto by means of a peelable and re-sealable adhesive, the flap extending fully across one face of the package and at least partially down opposing sides to form a sealed and re-closable closure for the package.

The packaging may be configured such that in use, the free edges of the flap can be peeled away from the further portion of the wrapper and the flap folded back to expose an opening or aperture at one end of the package through which the product can be removed. The flap may be configured to enable the product to be removed through the opening in a longitudinal direction.

The wrapper may be sealed along its length by means of a longitudinal fin seam, which may be positioned on the opposite side of the package from the flap.

The wrapper may be closed at either end by means of a sealed transverse seam.

The flap may be foldably connected along one edge adjacent one of the transverse seams and may be rotatable about the transverse seam. The one or more seams may be located in a central portion of the package, or may be off-set from a central portion.

In one embodiment, the packaging is a flow-wrap film packaging.

The re-sealable adhesive may be a cold seal adhesive.

The seal between the flap and the further portion of the wrapper may comprise a tamper-evident seal. Alternatively, a temper-evident label may be employed. The free edges of the flap may be sealed to the further portion of the wrapper by means of two seals, a first breakable seal and a second, peelable and re-sealable seal.

The packaging may comprise at least one peelable panel portion formed in a face of the packaging, which peelable panel portion can be peeled away from the remainder of its respective face to increase the depth of the opening after the flap has been opened. The packaging may comprise a first peelable panel portion formed in a face of the package across which the flap extends, the first peelable panel portion extending part way along the face from an edge of the face which defines the opening. In addition or alternatively, the packaging may comprise a second peelable panel portion in a second face of package opposite from the face across which the flap extends. The, or each, peelable panel portion may have edge regions which overlap corresponding edge regions of the remainder of their respective packaging face, the overlapping edge regions being releasably bonded together. The overlapping edge regions may be bonded together using a peelable and re-sealable adhesive.

The packaging may be for a generally blocked shaped food product, which may be a confectionery bar.

The generally blocked shaped product may comprise two or more generally block shaped portions.

In accordance with a second aspect of the invention, there is provided a combination of packaging in accordance with the first aspect and a generally blocked shaped product enclosed by the packaging.

The product may be a food product which may be a chocolate or other confectionery bar.

In accordance with a third aspect of the invention, there is provided a method of packaging a generally blocked shaped product, the method comprising:

a) providing a wrapper of flexible material having a re-sealable flap closing an aperture in the wrapper;
b) folding the wrapper about a generally block shaped product and bonding opposed surfaces of the material to form sealed seams so as to encase the product;
c) positioning the wrapper as it is folded about the product so that the flap is located adjacent one end of the package and extends fully across one face of the package and at least partially down opposing sides.

The step of folding the wrapper about a generally block shaped product and bonding opposed surfaces of the material to form sealed seams so as to encase the product may comprise forming a longitudinal sealed seam and a transverse sealed seam at either end of the product, the re-sealable flap being foldably connected along one edge adjacent one of the transverse seams.

The method may comprise forming the longitudinal seam along a rear face of the package, the flap being positioned to extend across a front face opposite the rear face. Alternatively, the method may comprise forming the longitudinal seam along a front face of the package, the flap being positioned to traverse at least part of the rear face.

The packaging may be produced using a flow-wrap method, the wrapper being provided as part of a roll of material having a plurality of re-sealable flap portions spaced along its length, the material being folded about the product so that opposing longitudinal edge regions of the material are brought into contact and bonded together to form the longitudinal seam, opposing regions of the material at either end of the product being brought into contact and bonded to form the transverse end seams and the material being cut to separate the package from the remainder of the film.

The method may comprise providing a wrapper having at least one peelable panel portion and positioning the wrapper so that the panel portion is positioned on a face of the packaging.

The method may comprise cutting the wrapper material to produce an integral flap portion. The wrapper may be cut to form the flap portion using a laser treatment. Alternatively, the wrapper may be cut to form a flap using mechanical means. A releasable adhesive may be at least partially applied to the integral wrapper portion. If desired, a releasable adhesive may be applied to the integral wrapper portion in discrete areas, resulting in some areas of the wrapper portion being free of adhesive. Where the packaging is produced using a flow-wrap method, the method may include producing a roll of material having a plurality of pre-cut flap portions.

In accordance with a fourth aspect of the invention, there is provided a combination of a substantially rigid, generally block shaped product and a wrapper of flexible material enclosing the product, the wrapper having an aperture and a foldable flap portion, the flap portion having one or more free edge regions overlapping a further portion of the wrapper and being bonded thereto by means of a peelable and re-sealable adhesive so as to form re-closable closure for the aperture, in which the aperture has a maximum width equal to or slightly larger than a side of the product.

The aperture may have a maximum width that is in the range of 1% to 15%, 1% to 14%, 1% to 13%, 1% to 12% or 1% to 11% larger than the side of the product.

The aperture may have a maximum width that is in the range of 1% to 10% larger than the side of the product. Alternatively, the aperture may have a maximum width that is in the range of 1% to 9%, 1% to 8%, 1% to 7% or 1% to 6% larger than the side of the product.

The aperture may have a maximum width that is in the range of 1% to 5% larger than the side of the product.

The product may be generally rectangular in plan having longer and shorter edges and the flap and aperture may be aligned with one of the longer side edges of the product.

The product may be generally rectangular in plan having longer and shorter edges and the flap and aperture may be aligned with one of the shorter side edges of the product.

The product could be potentially any shape in plan, such as rectangular or have undulating edges.

The wrapper may have two flap portions and two apertures, a first flap portion and aperture being aligned with one of the side edges of the product and a second flap portion and aperture being aligned with another one of the side edges of the product.

The wrapper may have a longitudinal fin seal, and a portion of the fin seal may form a tab that can be grasped to open the flap.

The wrapper may be a flow-wrapped wrapper.

The wrapper may comprise at least one peelable panel portion formed in a face of the packaging, which peelable panel portion can be peeled away from the remainder of its respective face to increase the depth of the aperture after the flap has been opened. The packaging may comprise a first peelable panel portion formed in a face of the package across which the flap extends, the first peelable panel portion extending part way along the face from an edge of the face which defines the aperture. In addition or alternatively, the packaging may comprise a second peelable panel portion in a second face of package opposite from the face across which the flap extends. The, or each, peelable panel portion has edge regions which overlap corresponding edge regions of the remainder of their respective packaging face, the overlapping edge regions being releasably bonded together. The overlapping edge regions may be bonded together using a peelable and re-sealable adhesive.

The product may be a food product, which may be a chocolate or other confectionery bar.

The product may comprise two or more substantially rigid, generally block shaped portions arranged in-line within the wrapper. The product could comprise two or more chocolate or other confectionary bars arranged in-line, or side-by-side within the wrapper.

In accordance with a fifth aspect of the invention, there is provided a method of packaging a substantially rigid, generally blocked shaped product with a wrapper of flexible material, the method comprising:

a) providing a wrapper of flexible material having an aperture and a foldable flap portion, the flap portion having one or more free edge regions overlapping a further portion of the wrapper and being bonded thereto by means of a peelable and re-sealable adhesive so as to form re-closable closure for the aperture, and the aperture having a maximum width equal to or slightly larger than a side of the product;

b) folding the wrapper about a generally block shaped product and bonding surfaces of the material to form sealed seams so as to encase the product;

c) positioning the wrapper as it is folded about the product so that the aperture in the wrapper is located adjacent to one side of the package.

In accordance with a sixth aspect of the invention, there is provided a packaging for a generally block shaped product, the packaging comprising a wrapper of flexible material encasing the product, the wrapper having a foldable flap portion adjacent an end of the package, the free edges of the flap overlapping a further portion of the wrapper and being bonded thereto by means of a peelable and re-sealable adhesive, the flap extending at least partially across a first face of the package to form a sealed and re-sealable closure for the package, the package also having a first peelable panel portion formed in the first face of the packaging and a second peelable panel portion forming in a face of the packaging opposite from the first face, each of the first and second peelable panel portions being configured so that it can be peeled away from the remainder of its respective face to increase the depth of an opening in the packaging produced when the flap is opened.

DETAILED DESCRIPTION OF THE INVENTION

Several embodiments of the invention will now be described, by way of example only, with reference to the accompanying drawings, in which.

The same reference numerals but increased by 100 in each case are used in relation to the various embodiments described below.

Figure 1:
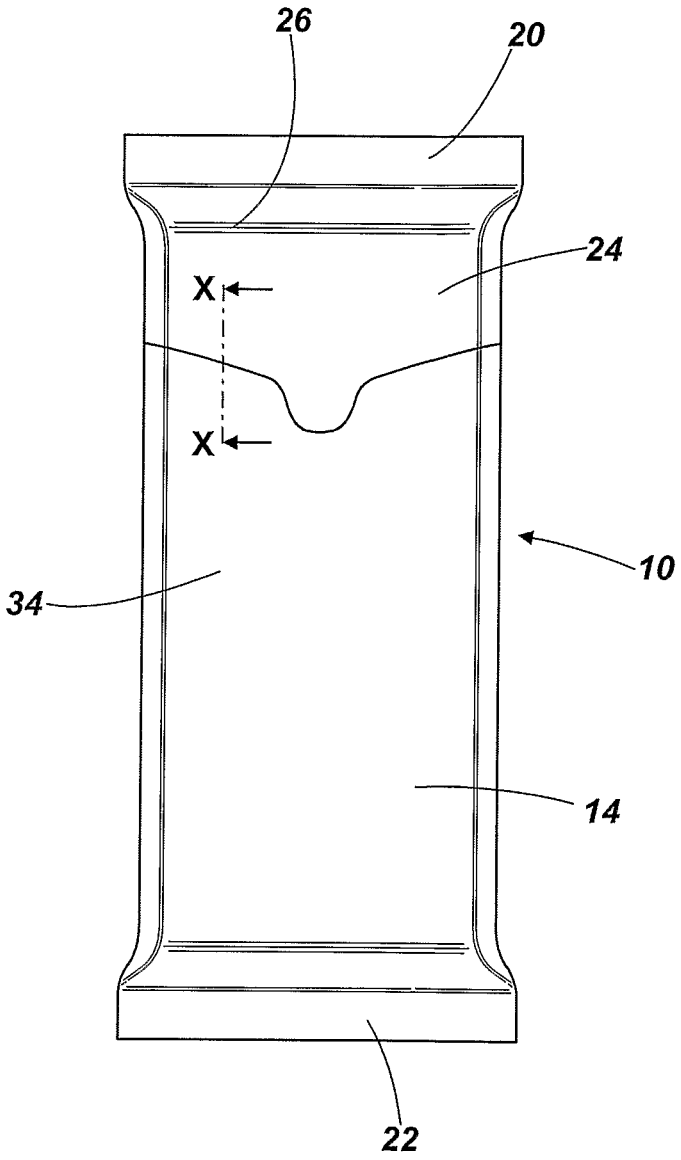
FIG. 1 is a plan view of a first embodiment of a packaging in accordance with the present invention, showing the packaging in a closed condition.

Packaging in accordance with a first embodiment of the invention is indicated generally at 10. The packaging 10 in accordance with the present embodiment is particularly suited for packaging generally block shaped food products such as chocolate bars 12 or other similar confectionery products. However, the packaging 10 can be adapted for packaging other generally block shaped products. The packaging 10 can also be used to package products provided in two or more generally block shaped portions. For example, the packaging 10 could be used to package multiple chocolate or other confectionery bars arranged in-line.

The packaging 10 comprises a wrapper 14 of flexible material which is folded around the product and sealed to fully enclose the product. Overlapping longitudinal edge regions of the wrapper 14 are bonded together to form a longitudinal fin seam 16 which extends along a rear face 18 of the packaging. Opposing end edge regions of the material are bonded together to form transverse sealed seams 20, 22 at either end of the product.

Figure 2:
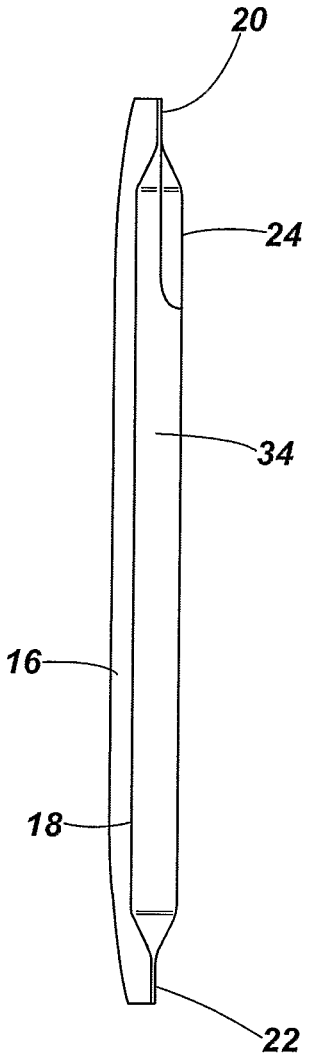
FIG. 2 is a side view of the packaging of FIG. 1.
Figure 3:
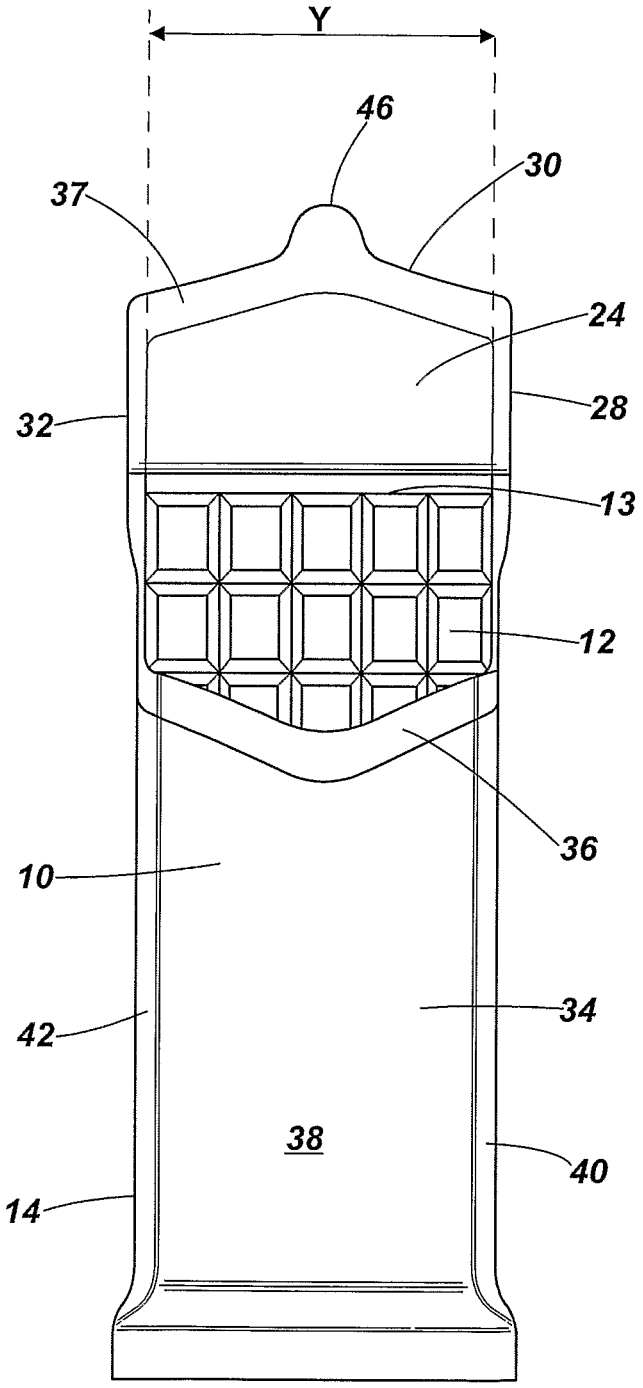
FIG. 3 is a view similar to that of FIG. 1 but showing the packaging in an open condition.
Figure 4:
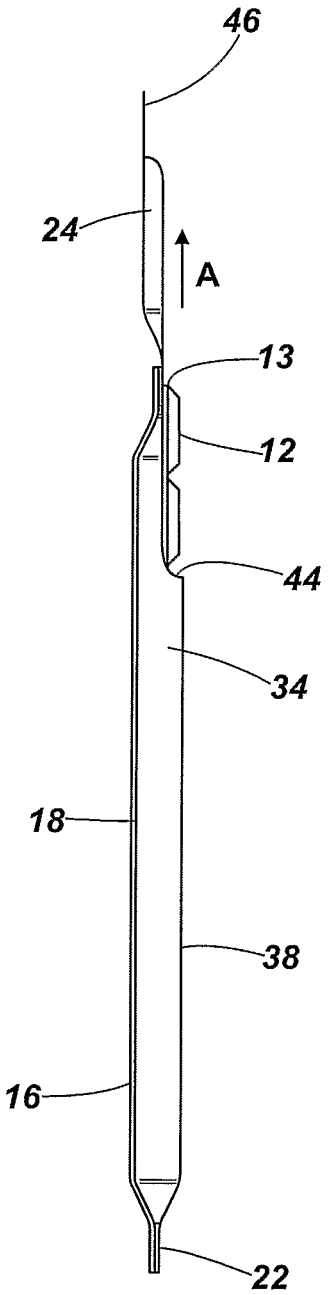
FIG. 4 is a side view of the packaging of FIG. 3.
Figure 5:
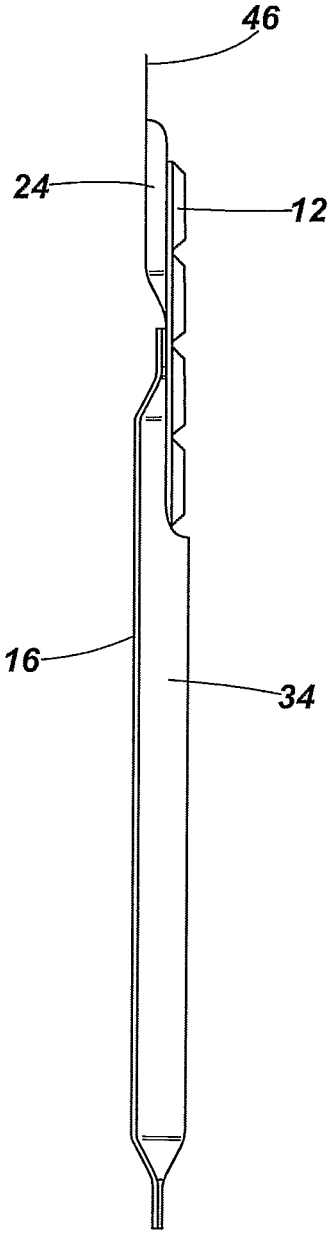
FIG. 5 is a further side view of the packaging of FIG. 3 showing the product partially removed.
Figure 6:
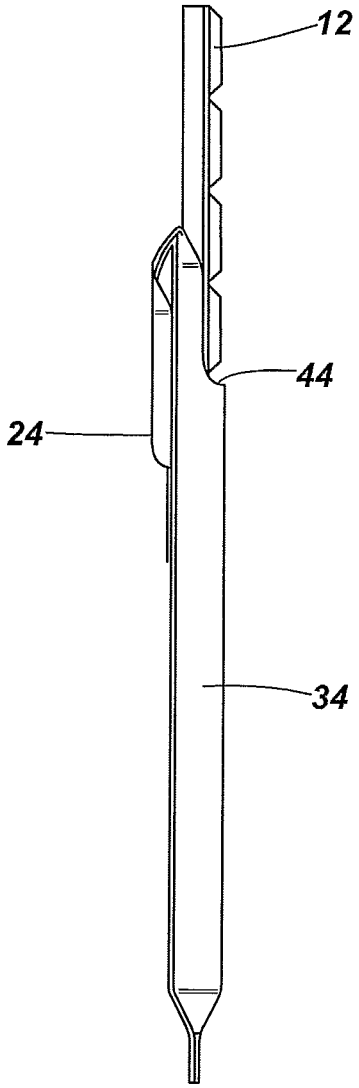
FIG. 6 is a further side view of the packaging in an open condition illustrating how a flap forming part of the packaging may be folded over to assist in sliding the product in and out.

The longitudinal seam 16 and the transverse seams 20, 22 can be formed using an adhesive to bond the opposing surfaces of the wrapper or by heating the material under pressure so that the opposing surfaces melt and fuse together to form a welded seam. Alternatively, an ultrasonic means of bonding the opposing surfaces together may be employed. In FIG. 2, the longitudinal fin seam 16 is shown projecting outwardly from the rear face 18 of the packaging for clarity. In practice, and as illustrated in FIGS. 4 and 6, the fin seam 16 is folded over to one side or the other. The fin seam 16 need not be positioned centrally along the rear face but may be offset to one side or another.

The wrapper can be made of any foldable material suitable for packaging the product concerned. Where the product is a food product, the material may be substantially moisture and gas impervious so that when it is fully sealed, the packaging provides a hermetically sealed container for the product. Alternatively, the package may be vented so as to enable the food product to be stored for longer periods (for example, Turkish Delight products require venting so as to prevent microbial activity during storage). Examples of typical materials that can be used include: paper based materials, one or more polymeric materials, and metallic foils. The wrapper may also be a lamination comprising layers of the same or different materials, which may include any of those mentioned above in any suitable combination. In one embodiment, the material comprises a laminate of a metal foil, which may be an aluminium foil, on one side and a plastics material on the other side. When the material is formed into the package, the metallic foil is positioned on the inside facing the product and the plastics material is on the outside. The plastics material may be printed on or otherwise provided with information for the consumer.

The wrapper 14 has an aperture which is closed by a flap portion 24 near to one end which forms a sealed and re-closable end closure for the packaging. The flap 24 is foldably connected with the remainder of the wrapper 14 along one edge 26 adjacent to the transverse seam 20 at one end of the package. The flap has three free edges 28, 30 32, which overlap a main body portion 34 of the wrapper. The free edges 28, 30, 32 of the flap are bonded to the overlapping region 36 of the main body portion by means of a peelable and re-sealable adhesive 37. In some instances, the re-sealable adhesive 37 only extends along part of the flap. The flap extends fully across the front face 38 of the package and at least partially down opposing sides 40, 42 so that when it is peeled back, it reveals an opening or aperture 44 at the end of the package through which the product 12 can be removed in a longitudinal direction as indicated by arrow A in FIG. 4. A tab 46 is provided on the free end 30 of the flap which overlies the front face 38 of the main body portion. The tab 46 is not fully stuck to the front face 38 of the package and can be grasped by a consumer to peel the flap 24 open.

The peelable and re-sealable adhesive 37 may be a cold seal adhesive and may be applied to the free edges of the flap 24 or to the overlapping region 36 of the main body portion 34 or both. The flap seal may include a tamper evident seal arrangement which provides a visual indication when the flap has been opened. The flap arrangement could include two seals, a first seal which breaks when the flap is first opened and a second, peelable and re-sealable seal to enable the package to be re-closed after it has been opened. The first, breakable seal will usually be positioned outside the second peelable seal so that a clear visual indication is given to potential consumers if the flap 24 has been opened and re-closed.

Although the peelable seal on the flap 24 is referred to as being re-sealable, in practice the peelable seal will not usually be expected to form a hermetic seal when the flap is re-closed. However, when the flap 24 is re-closed it will hold the remaining contents securely in the package and will provide some protection for the product from the environment. References to the flap being "re-sealed" or "re-sealable" should be construed accordingly. However, where the packaging is used to package a food product such as a chocolate bar, it is expected that the flap 24 will be fully sealed when the package is formed prior to the first opening, so that the packaging initially forms a sealed package. Thus the first breakable seal may be arranged to hermetically seal the flap 24 whereas the second peelable seal may simply be arranged to hold the flap in position when re-closed without forming a perfect seal. Accordingly, the peelable adhesive forming the second seal may not be applied to the whole surface area of the free edges of the flap 24.

The packaging 10 can be produced using a flow-wrap method in which a film of material having a number appropriately positioned flap portions 24 disposed along its length is supplied in a roll to package products 12 in a substantially continuous process. The material is fed through a machine which folds it about each product in turn so that opposing longitudinal edge regions are brought into contact and bonded together to form the longitudinal seam 16. The material is crimped at either end of the product to form the transverse end seams 20, 22 and the material is cut to separate each package from the remainder of the film.

Figure 7:
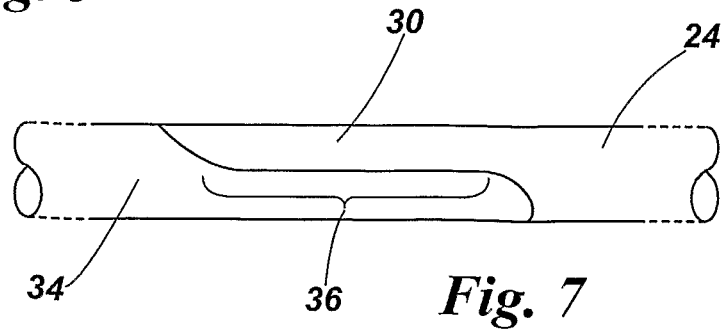
FIG. 7 is a cross sectional view in an enlarged scale through part of a wrapper taken on line X-X of FIG. 1.

In a preferred embodiment, the flap portion 24 is an integral part of the wrapper and is formed in the wrapper material by laser treatment (e.g. laser cutting /etching) or by mechanical means so as to produce overlapping regions 36 along the free edges 28, 30, 32 of the flap 24. FIG. 7 is a cross sectional view through the edge 30 of the flap 24 and illustrates how a cut is made through the material following a stretched or elongate "S" shaped path 48 to create an overlapping region 36 between the free edge 30 and the main body portion 34. Where the package is produced using a flow-wrap, envelope or panel wrapping, the flap portions 24 are pre-cut in the film of material.

Figure 8:
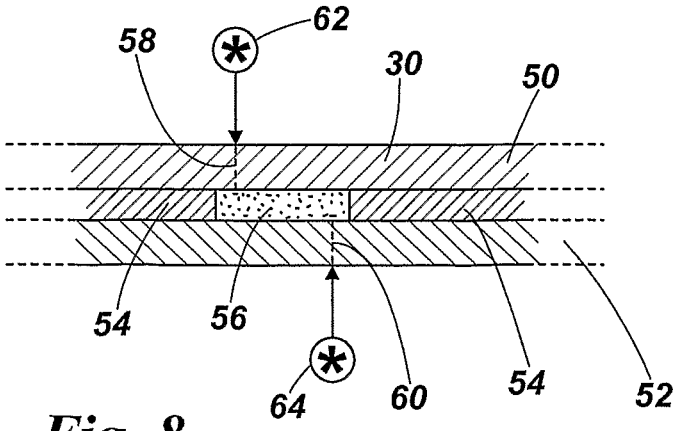
FIG. 8 is a view similar to that of FIG. 7 but illustrating the method of producing the flap where the wrapper is a laminate.

An alternative arrangement for producing the flap where the material is a laminate is shown in FIG. 8. In this embodiment, the material has an inner layer 50, which may be a metallic foil or another metallised material, and an outer layer 52 which may be a plastics material but any suitable laminate can be used. The two layers 50, 52 are bonded together by a permanent adhesive 54 over the majority of their areas. However, in at least part of the region where the overlapping free edges 28, 30, 32 of the flap are to be produced, the layers 50, 52 are bonded together by means of a peelable and re-sealable adhesive 56. A first cut or line of weakness 58 is formed though the plastic outer layer and denotes the outer edge of the flap 24. A second cut or line of weakness 60, spaced inwardly from the first, is formed through the inner, metallic layer 52. The distance between the first and second cuts or lines of weakness 58, 60 defines the width of the overlapping edge regions of the flap 14.

The first and second cuts 58, 60 may be produced using one or more lasers as indicated by the arrows 62, 64 after the two layers 50, 52 have been laminated. Because the two layers 50, 52 are different materials, the lasers 62, 64 may be operated at different frequencies to produce the required depth of cut. In addition or as an alternative, the depth of cut produced by the lasers can be at least partly controlled by having at least one layer of material in the laminate which incorporates or is coated with a laser retardant additive having laser retarding properties. The laser retardant additive may be an ink and in particular a metallic ink. In one embodiment, the laminated material includes a continuous metallic foil bonded to a second layer of material which incorporates or is coated with the laser retardant additive.

The term "laser retardant additive" should be taken to mean any material which is capable of hindering, attenuating or mitigating the passage of electromagnetic radiation in the spectrum commonly used by laser (light amplification by simulated emission of radiation).

In an alternative method, the first and second cuts 58, 60 are produced by passing the laminated material between a pair of contra-rotating die cylinders, one of the cylinders contacting the outer layer 52 and one the inner layer 50, each of the cylinders having one or more blades which form a cut in the respective layer.

The first and second cuts or lines of weakness 58, 60 could be produced prior to the two layers 50, 52 being laminated. In this case, a line of perforations will be produced in the material forming each layer 50, 52 and the layers arranged so that when they are laminated, the lines of perforation 58, 60 are aligned as illustrated in the FIG. 8.

The packaged product is supplied with the flap 24 in a closed and sealed condition. A consumer opens the package 10 by grasping the tab 46 and peeling the flap 24 away from the main body portion 34 to reveal an opening or aperture 44 through which the rigid bar 12 can be slid out of the main body portion 34 of the package in a longitudinal direction, as indicated by the arrow A in FIG. 4. Where the bar 12 is a portioned bar, it need be slid out only far enough to enable the consumer to break off one or more portions as required. Alternatively, the bar 12 can be a solid bar, at least part of which can be broken off when desired. The remaining bar 12 can then be slid back into the package and the flap 24 re-sealed to keep it secure. As illustrated in FIG. 6, due to the flexible nature of the material and the width of the flap 24, the flap 24 may be folded right around the back of package about the transverse end seam 20 to enable easy access to the product.

The opening or aperture 44 is dimensioned to enable the product 12 to pass through when the flap 24 is opened. Accordingly, the aperture 44 has a width which is equal to or just slightly larger than the side 13 of the product 12 which is aligned with and faces the aperture. Typically, the aperture 44 will be dimensioned so that its maximum width Y is in the range of 1% to 10% larger than the side 13 of the product 12 which must pass through the aperture. In some embodiments, the aperture may have a maximum width that is in the range 1% to 5% larger than the side 13 of the product 12 which is aligned with the aperture.

Packaging 10 in accordance with the invention is particularly suitable for use in packaging chocolate or other confectionery bars as it allows the consumer to easily open the packaging periodically to remove one or more portions and holds the remaining contents in a secure and sealed container. However packaging in accordance with the invention may also be useful in packaging smaller "snack" size bars as it provides an easy to open package which produces less mess than the known packaging. In some cases, more than one bar may be contained in the package, with the bars arranged in-line or side-by-side. In this case, the package 10 can be opened and one of the bars removed before the flap is re-closed to hold the remaining bar or bars in that package. Indeed as has already been stated, packaging 10 in accordance with the invention can be adapted to pack any generally block shaped food or even non-food product where is it is desirable to have packaging which is easy to open and re-close.

It will be appreciated that the shape of the flap 24 can be varied from that shown in the first embodiment. For example, the flap 24 could be hemispherical or have some other curved shape so that it does not exhibit three distinct side edges but has what could be regarded as a single continuous free edge. Indeed the flap 24 can have any suitable shape and can have one, two, three or more free edge regions. Furthermore, the flap 24 need not be positioned adjacent a longitudinal end as shown. In some cases the pack may be oversized so that it is longer than the product. In this case, the flap 24 could be positioned in-board from the end provided the product can be manoeuvred through the opening 44.

Figure 9:
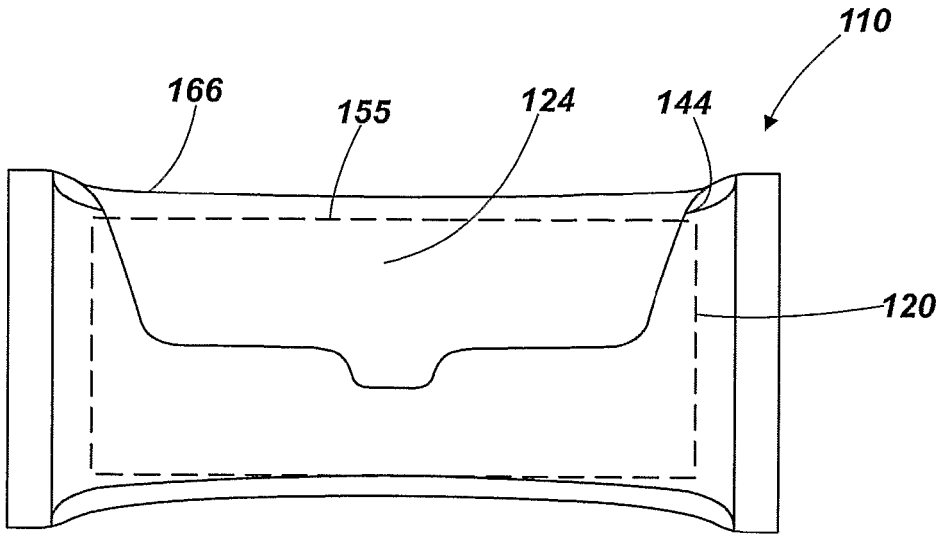
FIG. 9 is a plan view of a packaging in accordance a second embodiment of the present invention, showing the packaging in a closed condition.

FIG. 9, illustrates an embodiment of a package 110 in which the flap 124 is positioned along one of the longer side edges 166 of the package 110 so that the product 120 can be manoeuvred sideways out through the aperture 144. In FIG. 9, the exterior dimensions of the product 120 is indicated by the dashed line and it can be seen that the package 110 is oversized, being longer and wider than the product 120. The width of the aperture 144 closed by the flap 124 does not extend over the full length of the side edge 166 of the package but is dimensioned to enable the product to be passed out through the aperture 144. Thus the aperture 144 has a width which is equal to or just slightly larger than the longer side 155 of the product. As with the first embodiment, the aperture 144 will typically be dimensioned so that its width is in the range of 1% to 10% or the range 1% to 5% larger than the side 155 of the product 120 which is aligned with the aperture.

Figure 10:
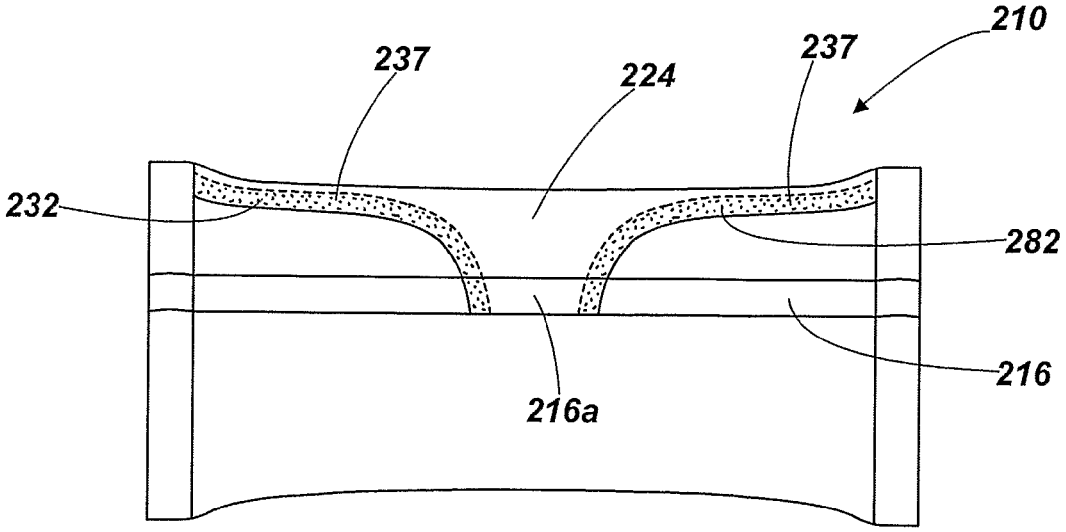
FIG. 10 is a plan view of a packaging in accordance a third embodiment of the present invention, showing the packaging in a closed condition.
Figure 13:
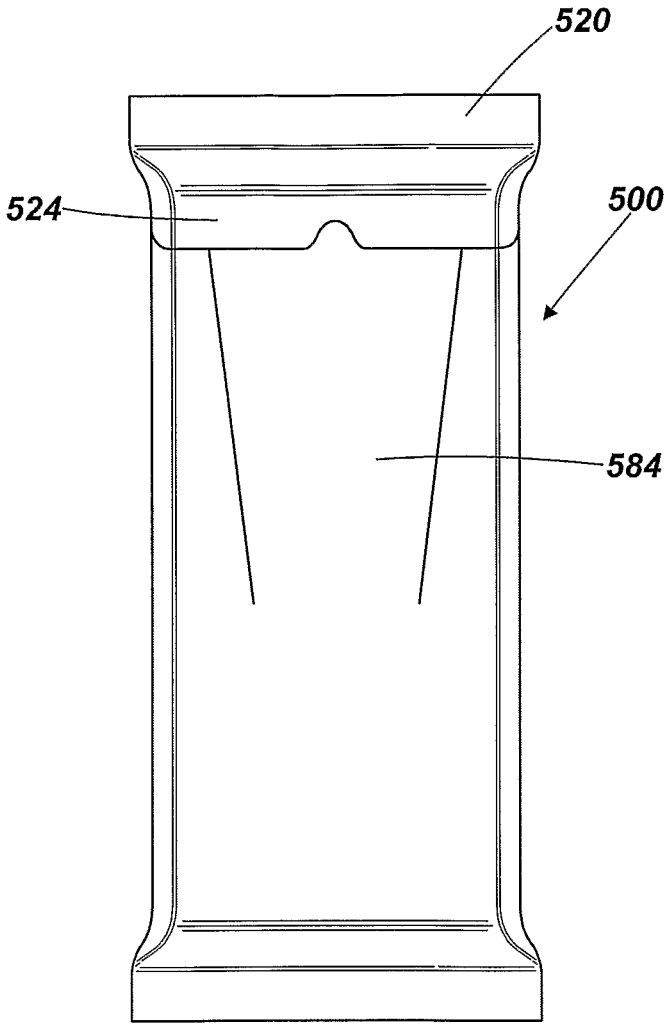
FIG. 13 is a plan view from the front of a packaging in accordance with a sixth embodiment of the invention in a closed condition.
Figure 14:
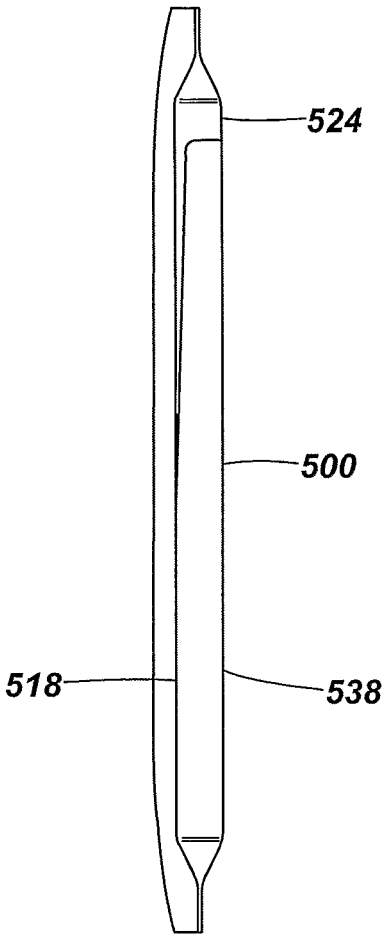
FIG. 14 is a side view of the packaging of FIG. 13.

FIG. 10 illustrates a further embodiment of a package 210 in which the flap 224 is provided along a side edge. In this embodiment, the flap 224 is provided on the rear face and the fin seam 216 is offset towards the side of the package in which the flap 224 is formed. Part 216*a* of the fin seam forms a tab or hand hold which can be grasped by a consumer to open the flap 224. In this embodiment, the peelable adhesive 237 is only applied along two side edge regions 282, 232 of the flap.

Figure 11:
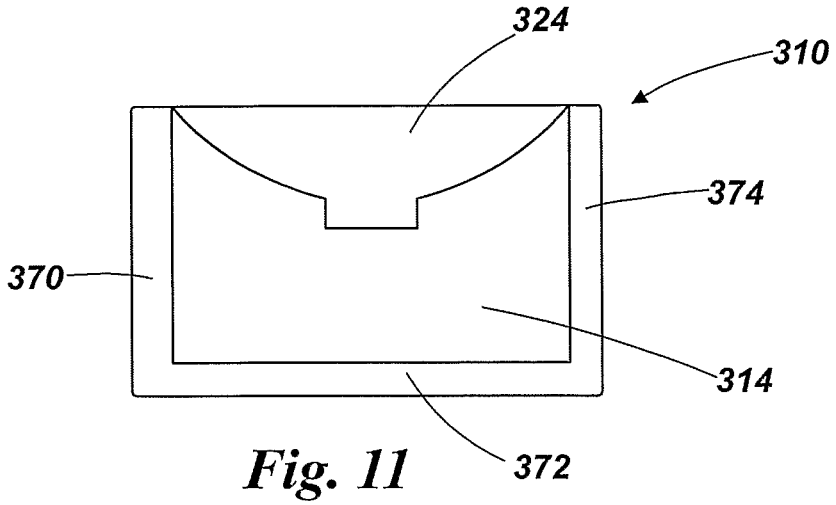
FIG. 11 is a plan view of a packaging in accordance a fourth embodiment of the present invention, showing the packaging in a closed condition.
Figure 12:
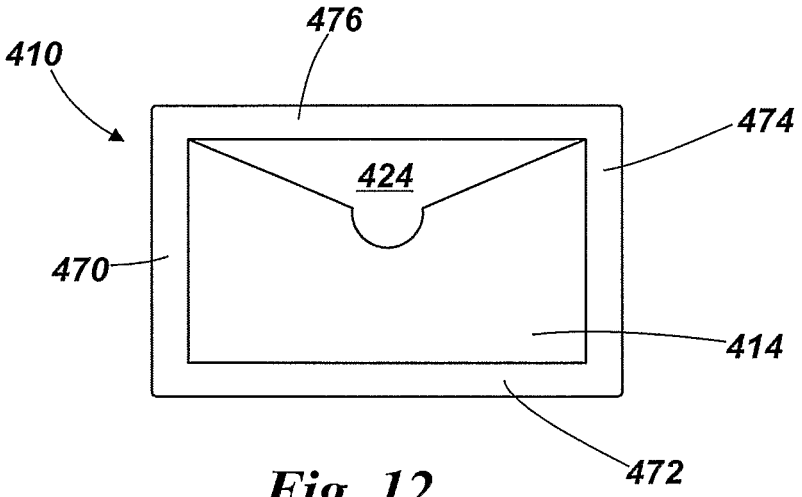
FIG. 12 is a plan view of a packaging in accordance a fifth embodiment of the present invention, showing the packaging in a closed condition

The invention is not limited to packaging comprising a longitudinal seam or which is formed using a flow-wrap method and apparatus. FIG. 11 illustrates schematically a packaging 310 in which the wrapper 314 comprises a sheet of flexile material 314 folded about the product and sealed along three edges 370, 372, 374. In the embodiment shown, a generally hemispherical flap 324 is provided along one of the longer side edges but the flap could be aligned with one of the shorter sides. FIG. 12 illustrates a further embodiment of a packaging 410 in which the wrapper 414 comprises two sheets of a flexible material positioned on opposite sides of the product. The sheets are bonded or welded together along all four sides to form seals 470, 472, 474, 476. A generally triangular re-sealable flap 424 is provided along one of the longer side edges. Again the flap 424 could be aligned with one of the shorter sides.

A further embodiment of a packaging 500 in accordance with the invention is illustrated in FIGS. 13 to 20.

The packaging 500 is similar to the packaging 10 of the first embodiment described above with reference to FIGS. 1 to 8 to which the reader should refer. Only the differences between the packaging 500 and the first embodiment 10 will be described in detail.

The packaging 500 has a re-closable flap 524 positioned adjacent to one longitudinal end of the packaging 500 to form a re-closable end closure. The flap 524 is essentially the same as the flap 24 in the first embodiment and can be produced using any of the methods discussed above. However, the flap 524 is somewhat smaller in length than the flap 24 in the first embodiment so that the opening 544 formed when the flap 524 is opened is shallower in depth than the opening 44 produced in the first embodiment 10 when the flap 24 is opened. This can be seen by comparing FIGS. 3 and 15. To make access to the product 512 easier for the user, the packaging 500 is provided with peelable first and second panel portions 584, 586 which close apertures in opposing faces of the packaging and which apertures form extensions of the aperture 544 closed by the flap 524.

Figure 17:
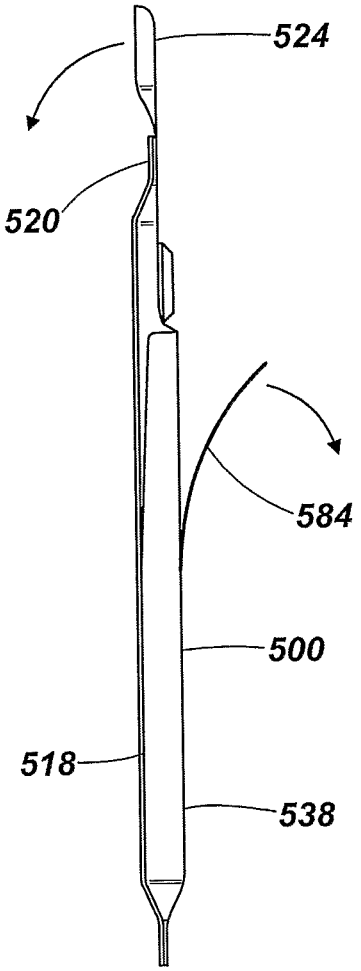
FIG. 17 is a view similar to that of FIG. 16 but illustrating opening of a peelable front panel portion.

The first or front panel portion 584 extends from an upper (as shown) edge 588 of the main panel portion 534 adjacent the opening 544 partway down a front wall region or face 538 of the man in body portion 534. The front panel portion 584 has a tab 590 on its upper edge that is exposed once the flap 524 is opened. The tab can be grasped by a user to peel the front panel portion down as shown in FIG. 17.

Figure 18:
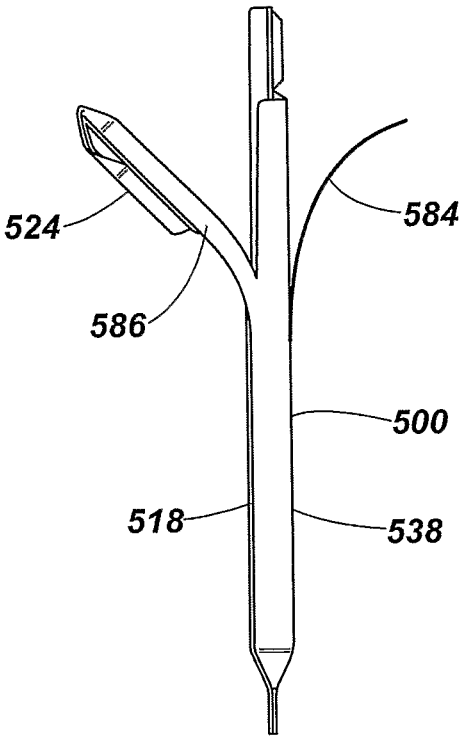
FIG. 18 is a view similar to that of FIG. 17 illustrating opening of a peelable rear panel portion.
Figure 19:
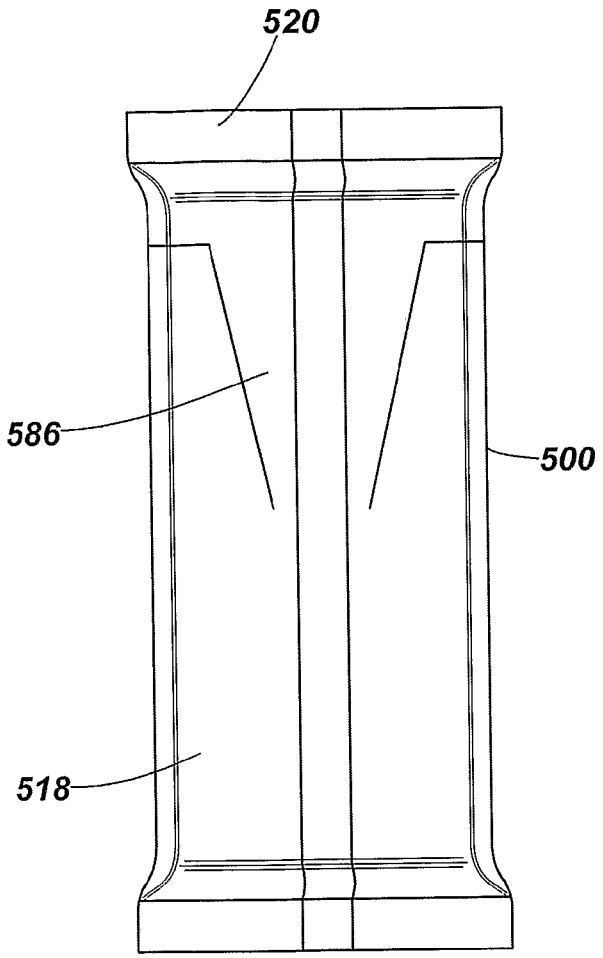
FIG. 19 is a plan view from the rear of the packaging of FIGS. 13 to 18 showing the packaging in a closed condition.
Figure 20:
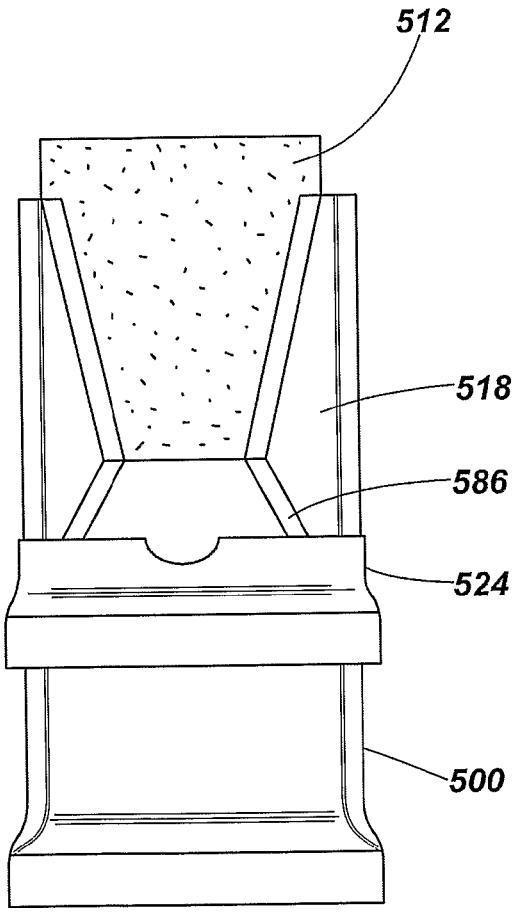
FIG. 20 is a view similar to that of FIG. 19 but showing the packaging in an open condition.

The second or rear panel portion 586 extends from an upper (as shown) region of a rear wall or face 518 of the main body 534 which is approximately level with the upper (as shown) edge of the front wall partway down the rear wall. At its upper end, the rear panel portion extends around the sides of the packaging to connect with the front wall of the main body at a position substantially in line with the upper edge of the front wall. This arrangement enables the rear panel portion 586, the flap 524 and the end seal 520 to be peeled downwardly as shown in FIG. 18 once the flap 524 has been opened.

Figure 15:
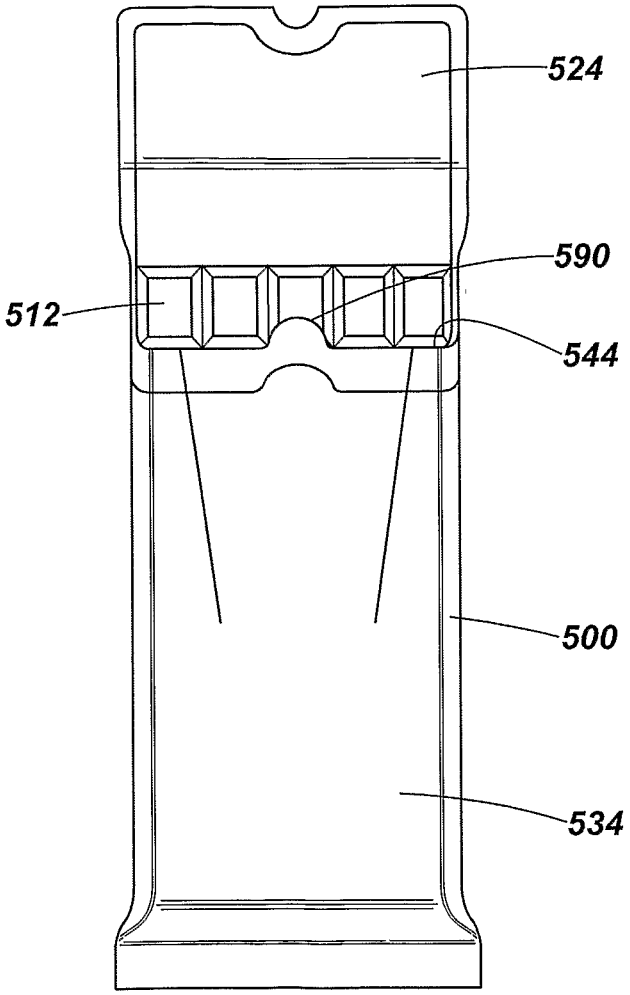
FIG. 15 is a view similar to FIG. 13 but showing a flap forming part of a re-closable closure in an open position.
Figure 16:
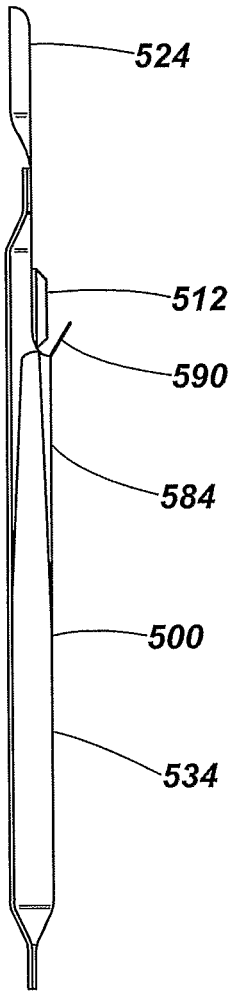
FIG. 16 is side view of the packaging of FIG. 15.

The front and rear panel portions 584, 586 can be formed in a manner similar to the flap 524 so that each panel portion has one or more free edge region which overlaps an edge region of the main body portion 534, with the overlapping edge regions being bonded together by means of a peelable adhesive which may be a re-sealable or re-closable adhesive. Where the packaging 500 is produced from a laminated material, the front and rear panel portions 584, 586 could be produced using the method of off set cuts as described above in relation to FIG. 8. To open the packaging 500, the user first peels the flap 524 open as illustrated in FIGS. 15 and 16. The user can then grasp the tab 590 and peel the front panel portion 584 open as illustrated in FIG. 17. The user can also continue to fold the opened tab 524 of the back and peal the rear panel portion 586 open as illustrated in FIG. 18. Peeling the front and real panel portions exposes more of the product making it easier to remove from the packaging. The user can also use the side portions 594 of the packaging between the front and rear panel portions to hygienically hold the product. Where the front and rear panel portions 584, 586 are bonded using a re-sealable or re-closable adhesive, the user can press the panel portions back into position and re-close the flap 524 to retain part of the contents in the packaging.

If desired, the packaging 500 may have only one of the front and rear peelable panel portions 584, 586.

The packaging 500 can be produced using a flow-wrap method as described above from a roll or web of material in which flaps 524 and the peelable panel portions 584, 586 are pre-formed.

Figure 21:
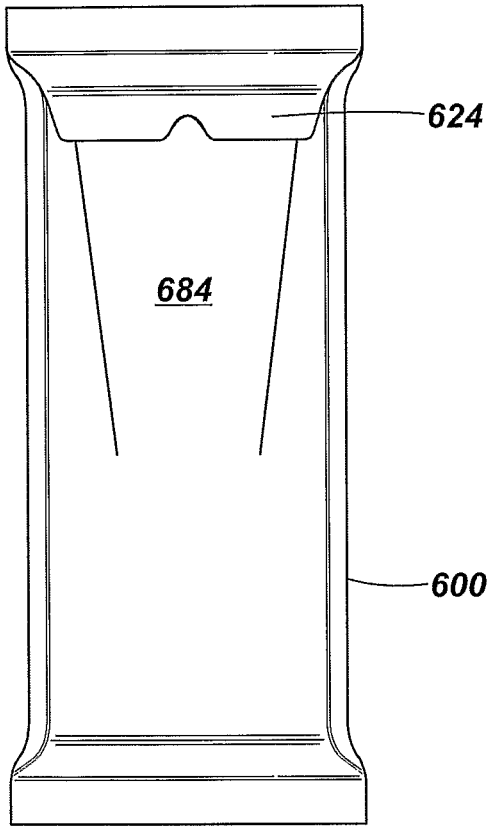
FIG. 21 is a plan view from the front of a packaging in accordance with a seventh embodiment of the invention in a closed condition; and, FIG. 22, is a side view of the packaging of FIG. 21 shown in a partially opened condition.
Figure 22:
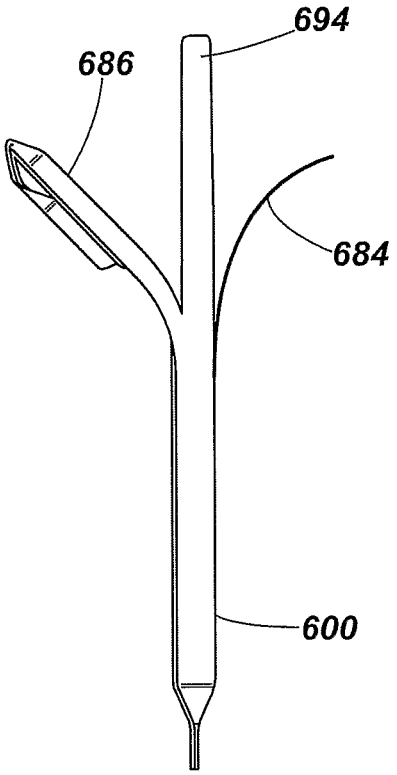

FIGS. 21 and 22 illustrated a further embodiment of a packaging 600 which is a modification of the embodiment 500 described above.

The packaging 600 is identical to the packaging 500 except that the flap 624 is formed solely in the front face of the packaging and does not extend down the opposing sides in accordance with the presently claimed invention. As a consequence, when the package is opened and the front and rear panel portions 684, 686 are peeled open, the side portions 694 between the front and rear panel portion encase the side regions of the product. To access the product, the user also peels the side portions downwardly.

Whilst the packaging 600 is not in accordance with the presently claimed invention, patent protection for this arrangement may be sort in due course.

It will be appreciated from the forgoing description that the flap 24, 124, 224, 324, 424, 524 and corresponding aperture 44, 144, 544 can be positioned in any suitable location on the package provided the rigid block shaped product 20, 120, 520 can be manoeuvred through the aperture once the flap is opened. Indeed, packaging in accordance with the invention may be provided with two or more flaps and corresponding apertures so that the consumer has the option of opening the package in different positions. For example, a package in accordance with the invention may be provided with a flap near one longitudinal end and a second flap along one of the longer sides to provide an option for side opening.

The foregoing embodiments are not intended to limit the scope of protection afforded by the claims, but rather to describe an example as to how the invention may be put into practice.

The invention claimed is:

1. A combination of a single, generally block shaped product and packaging for the product, the packaging comprising a wrapper of flexible material encasing the product, the wrapper having a foldable flap portion integrally formed therein adjacent or in-board of an end of the package, the free edges of the flap portion overlapping a further portion of the wrapper and being bonded thereto by means of a peelable and re-sealable adhesive;

characterised in that the wrapper is a flow-wrapped wrapper defining opposing side faces between a front face and an opposed rear face and sealed along its length by means of a longitudinal fin seam positioned adjacent the rear face on the opposite side of the package from the flap portion and at either longitudinal end by means of a transverse fin seam and in that the flap portion extends fully across the front face of the package and at least partially down the opposing side faces of the product to form a sealed and re-sealable closure for the package, the packaging being configured such that in use, the free edges of the flap portion can be peeled away from the further portion of the wrapper and the flap portion folded back to expose an aperture at one end of the package said aperture extending across said front face of said package and at least partially down said opposing side faces through which the product can be removed.

2. A combination as claimed in claim 1, in which the product is generally rectangular in plan and the flap portion is configured to enable the product to be removed through the aperture in a longitudinal direction.

3. A combination as claimed in claim 1, in which the flap portion is foldably connected along one edge adjacent one of the transverse seams.

4. A combination as claimed in claim 3, in which the flap portion is rotatable about said one of the transverse seams on opening.

5. A combination as claimed in claim 1, in which the packaging comprises at least one peelable panel portion formed in a face of the packaging, which peelable panel portion can be peeled away from its respective face to increase the depth of the aperture after the flap portion has been opened.

6. A combination as claimed in claim 5, in which the packaging comprises a first peelable panel portion formed in the face of the package across which the flap portion extends, the first peelable panel portion extending part way along the face from an edge of the face which defines the aperture.

7. A combination as claimed in claim 5, in which the packaging comprises a second peelable panel portion in a second face of package opposite from the face across which the flap portion extends.

8. A combination as claimed in claim 1, in which the generally blocked shaped product is a confectionery bar.

9. A combination as claimed in claim 1, in which the generally block shaped product is substantially rigid, the aperture having a maximum width equal to or slightly larger than a side of the product.

10. A combination as claimed in claim 9, in which the aperture has a maximum width that is in the range of 1% to 10% larger than the side of the product, preferably the aperture has a width that is in the range of 1% to 5% larger than the side of the product.

11. A combination as claimed in claim 9, in which the product is generally rectangular in plan having longer and shorter edges and the flap portion and aperture are aligned with one of the shorter side edges of the product.

12. A method of packaging a single, generally blocked shaped product, the method comprising:

a) providing a wrapper of flexible material having a re-sealable flap portion integrally formed therein closing an aperture in the wrapper;

b) folding the wrapper about the single, generally block shaped product and bonding opposed surfaces of the material to form sealed seams so as to encase the product;

characterised in that:

c) the packaging is produced using a flow-wrap method, the wrapper being provided as part of a roll of material having a plurality of re-sealable flap portions spaced along its length, the wrapper being folded about the product so that opposing longitudinal edge regions of the material are brought into contact and bonded together to form a longitudinal fin seam, opposing regions of the material at either end of the product being brought into contact and bonded to form transverse end seams and the material being cut to separate the package from the remainder of the roll; and by, d) positioning the wrapper as it is folded about the product so that the flap is located adjacent to or inboard of one end of the package and extends fully across one face of the package and at least partially down opposing sides of the product.

13. A method of packaging a generally blocked shaped product as claimed in claim 12, in which the re-sealable flap portion is foldably connected along one edge adjacent one of the transverse seams.

* * * * *